US012044081B2

(12) United States Patent
Larose et al.

(10) Patent No.: US 12,044,081 B2
(45) Date of Patent: Jul. 23, 2024

(54) ROD HANDLER APPARATUS IN CORE DRILLING

(71) Applicant: SERVICES DE FORAGE ORBIT GARANT INC., Val-d'Or (CA)

(72) Inventors: Daniel Larose, Val-d'Or (CA); Yves Bernard, Val-d'Or (CA); Mark Rose, Val-d'Or (CA); Jocelyn Bernier, Val-d'Or (CA)

(73) Assignee: SERVICES DE FORAGE ORBIT GARANT INC., Val-d'Or (CA)

( * ) Notice: Subject to any disclaimer, the term of this patent is extended or adjusted under 35 U.S.C. 154(b) by 347 days.

(21) Appl. No.: 17/425,845

(22) PCT Filed: Jan. 29, 2020

(86) PCT No.: PCT/CA2020/050105

§ 371 (c)(1),
(2) Date: Jul. 26, 2021

(87) PCT Pub. No.: WO2020/154804

PCT Pub. Date: Aug. 6, 2020

(65) Prior Publication Data

US 2022/0003050 A1 Jan. 6, 2022

Related U.S. Application Data

(60) Provisional application No. 62/798,160, filed on Jan. 29, 2019.

(51) Int. Cl.
*E21B 19/08* (2006.01)

(52) U.S. Cl.
CPC ..... *E21B 19/08* (2013.01)

(58) Field of Classification Search
CPC ..... E21B 19/08
See application file for complete search history.

(56) References Cited

U.S. PATENT DOCUMENTS 10,145,188 B2 12/2018 Smith et al.
2011/0048733 A1* 3/2011 Hudson ..... E21B 19/06 166/380

(Continued)

FOREIGN PATENT DOCUMENTS

CL 199400495 10/1995
WO WO-2020190196 A1 * 9/2020 ..... E21B 19/08

*Primary Examiner* — Dany E Akakpo
(74) *Attorney, Agent, or Firm* — NORTON ROSE FULBRIGHT CANADA LLP

(57) ABSTRACT

A rod handler apparatus for outer tubes and inner tubes, the rod handler apparatus has a manipulator arm adapted to be aligned with an elongated rod. An alignment jaw assembly is at a first end of the manipulator arm, the alignment jaw assembly translationally supports an inner tube and/or an outer tube in coaxial alignment with the elongated rod. A high-speed jaw assembly is at a second end of the manipulator arm, the high-speed jaw assembly adapted to support at least the inner tube, the high-speed jaw assembly operable to cause a translation of the inner tube in or out of the elongated rod. A low-speed jaw assembly is between the alignment jaw assembly and the high-speed jaw assembly, the low-speed jaw assembly adapted to support the outer tube, the low-speed jaw assembly operable to cause concurrent translation and rotation of the outer tube for screwing engagement with the elongated rod.

25 Claims, 18 Drawing Sheets

(56) References Cited

U.S. PATENT DOCUMENTS

| | | | | |
|---|---|---|---|---|
| 2011/0247880 | A1 | 10/2011 | Wrede et al. | |
| 2014/0209382 | A1 | 7/2014 | Smith et al. | |
| 2020/0157892 | A1* | 5/2020 | Gagnon | E21B 19/16 |

* cited by examiner

ROD HANDLER APPARATUS IN CORE DRILLING

TECHNICAL FIELD

The application relates to rod handler apparatuses of the type used in mining core drilling.

TECHNICAL FIELD

The application relates to rod handler apparatuses of the type used in mining core drilling.

BACKGROUND

In core drilling, cores of rock material are mined. In such cases, to reach suitable drilling depths, outer tubes are assembled end to end to form an elongated rod or pipe in which inner tubes may be conveyed from a distal head assembly to a proximal end. As the elongated rod may be several thousand feet long, the assembly of outer rods, and the constant feed of inner tubes may be manipulation intensive.

SUMMARY

In one aspect, there is provided a rod handler apparatus for outer tubes and inner tubes, the rod handler apparatus comprising: a manipulator arm adapted to be aligned with an elongated rod; an alignment jaw assembly at a first end of the manipulator arm, the alignment jaw assembly adapted to translationally support an inner tube and/or an outer tube in coaxial alignment with the elongated rod; a high-speed jaw assembly at a second end of the manipulator arm, the high-speed jaw assembly adapted to support at least the inner tube, the high-speed jaw assembly operable to cause a translation of the inner tube in or out of the elongated rod; and a low-speed jaw assembly between the alignment jaw assembly and the high-speed jaw assembly, the low-speed jaw assembly adapted to support the outer tube, the low-speed jaw assembly operable to cause concurrent translation and rotation of the outer tube for screwing engagement with the elongated rod.

Further in accordance with the aspect, for instance, the alignment jaw assembly is actuatable in a single degree of freedom to clamp onto the inner tube and/or the outer tube.

Still further in accordance with the aspect, for instance, the alignment jaw assembly has a linear actuator to actuate a pair of jaw portions of the alignment jaw assembly to clamp onto the inner tube and/or the outer tube.

Still further in accordance with the aspect, for instance, the alignment jaw assembly has ball roller interfaces for interfacing with the inner tube and/or the outer tube.

Still further in accordance with the aspect, for instance, the ball roller interfaces are passive.

Still further in accordance with the aspect, for instance, the alignment jaw assembly is fixed to the manipulator arm.

Still further in accordance with the aspect, for instance, the high-speed jaw assembly is actuatable in a single degree of freedom to clamp onto the inner tube and/or the outer tube.

Still further in accordance with the aspect, for instance, the high-speed jaw assembly has a linear actuator to actuate a pair of jaw portions of the high-speed jaw assembly to clamp onto the inner tube and/or the outer tube.

Still further in accordance with the aspect, for instance, the high-speed jaw assembly has a pair of rollers for interfacing with the inner tube and/or the outer tube, at least one of the rollers being driven and having a rotation axis transverse to a direction of translation of the inner tube and/or the outer tube.

Still further in accordance with the aspect, for instance, the rollers are elongated concave rollers.

Still further in accordance with the aspect, for instance, at least one of the rollers as a wavy outline.

Still further in accordance with the aspect, for instance a motor and a transmission may couple the motor to the driven one of the rollers.

Still further in accordance with the aspect, for instance, the driven one of the rollers has a textured contact surface.

Still further in accordance with the aspect, for instance, the high-speed jaw assembly is fixed to the manipulator arm.

Still further in accordance with the aspect, for instance, the low-speed jaw assembly is actuatable in a single degree of freedom to clamp onto the outer tube.

Still further in accordance with the aspect, for instance, the low-speed jaw assembly has a linear actuator to actuate a pair of jaw portions of the low-speed jaw assembly to clamp onto the outer tube.

Still further in accordance with the aspect, for instance, the low-speed jaw assembly has rollers for interfacing with the outer tube, at least one of the rollers being driven and having a rotation axis parallel to a direction of translation of the outer tube.

Still further in accordance with the aspect, for instance, the rollers are cylindrical rollers.

Still further in accordance with the aspect, for instance, the low-speed jaw assembly has two driven ones of the rollers, and two idler ones of the rollers, and wherein the low-speed jaw assembly is mounted to a frame of the manipulator arm to translate relative to the frame to impart the concurrent translation and rotation to the outer tube.

Still further in accordance with the aspect, for instance, a motor and a transmission may couple the motor to the driven one of the rollers.

Still further in accordance with the aspect, for instance, the driven one of the rollers has a textured contact surface.

Still further in accordance with the aspect, for instance, a base may supporting the manipulator arm.

Still further in accordance with the aspect, for instance, the base provides degrees of freedom of movement to the manipulator arm.

Still further in accordance with the aspect, for instance, the base provides two rotational degrees of freedom of movement to the manipulator arm, the two rotational degrees of freedom being actuated.

In accordance with another aspect, there is provided a system for manipulating outer tubes and inner tubes comprising: one or more processing units; and a transitory computer-readable memory communicatively coupled to the processing unit and comprising computer-readable program instructions executable by the processing unit for clamping onto an outer tube with a rod handler apparatus; screwing the outer tube onto an elongated rod with the rod handler apparatus; clamping onto an inner tube with the rod handler apparatus; and translating the inner tube in or out of the elongated rod with the rod handler apparatus.

Further in accordance with the other aspect, for instance, translating the outer tube toward the elongated rod with the rod handler apparatus may occur prior to screwing the outer tube.

Still further in accordance with the other aspect, for instance, the translating the outer tube has a greater velocity than a translation during the screwing of the outer tube.

Still further in accordance with the other aspect, for instance, the translating the inner tube has a greater velocity than a translation during the screwing of the outer tube.

Still further in accordance with the other aspect, for instance, a robotic arm may be actuated to align a manipulator arm of the rod handler apparatus with the elongated rod prior to the screwing.

DESCRIPTION OF THE DRAWINGS

Reference is now made to the accompanying figures in which.

DETAILED DESCRIPTION

Figure 1:
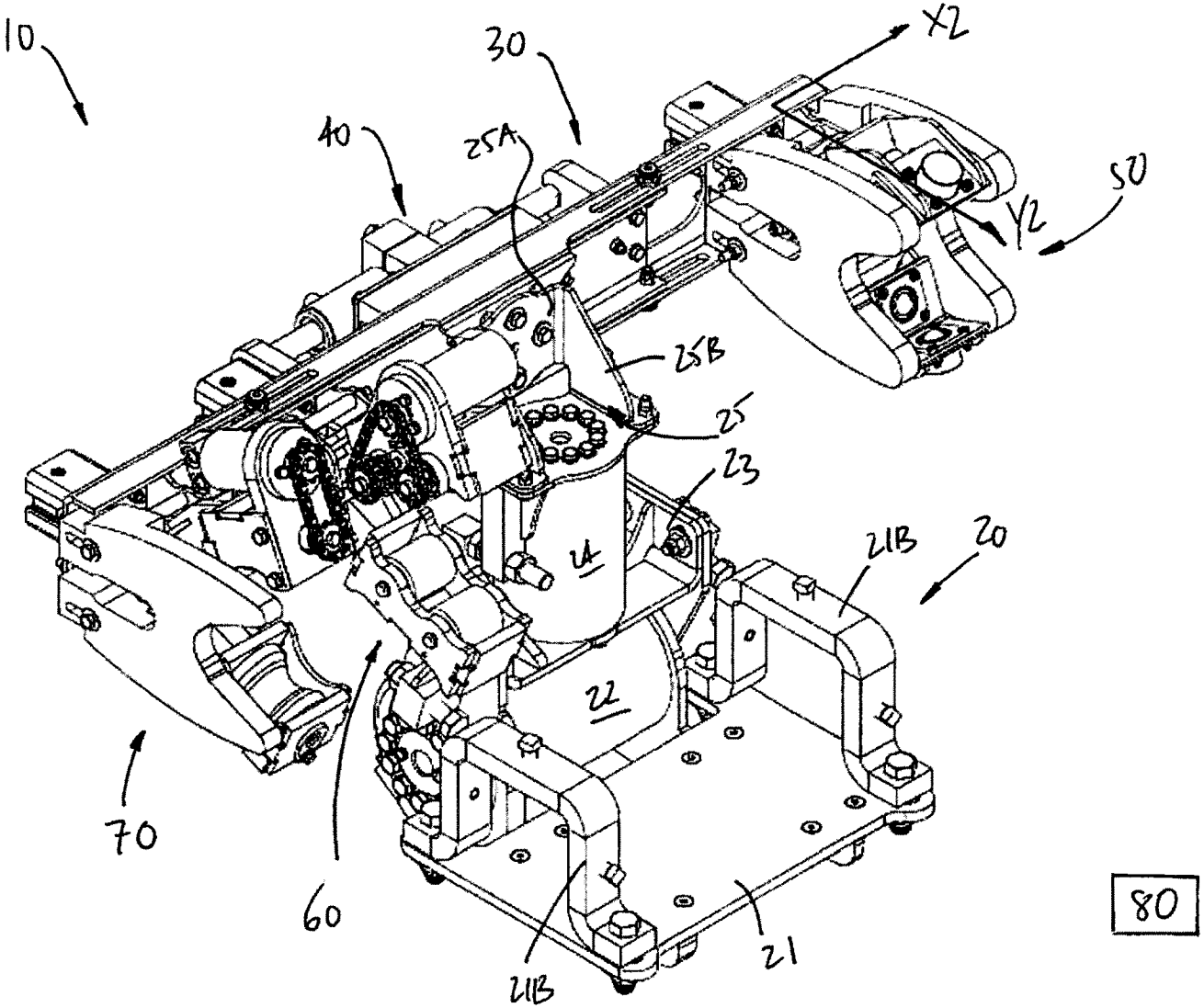
FIG. 1 is a first front perspective view of a rod handler apparatus in accordance with the present disclosure.
Figure 2:
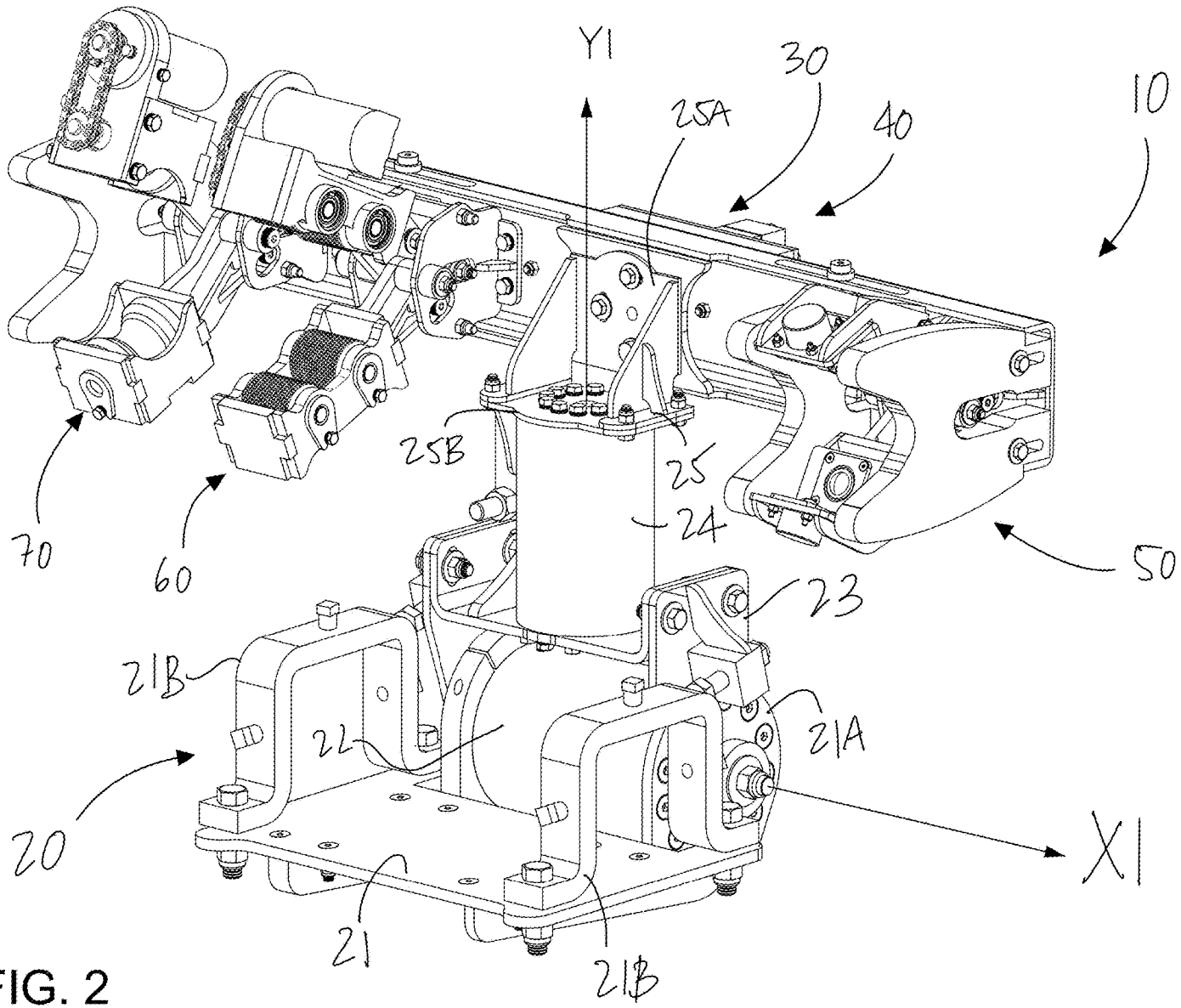
FIG. 2 is second front perspective view of the rod handler apparatus of FIG. 1.
Figure 3:
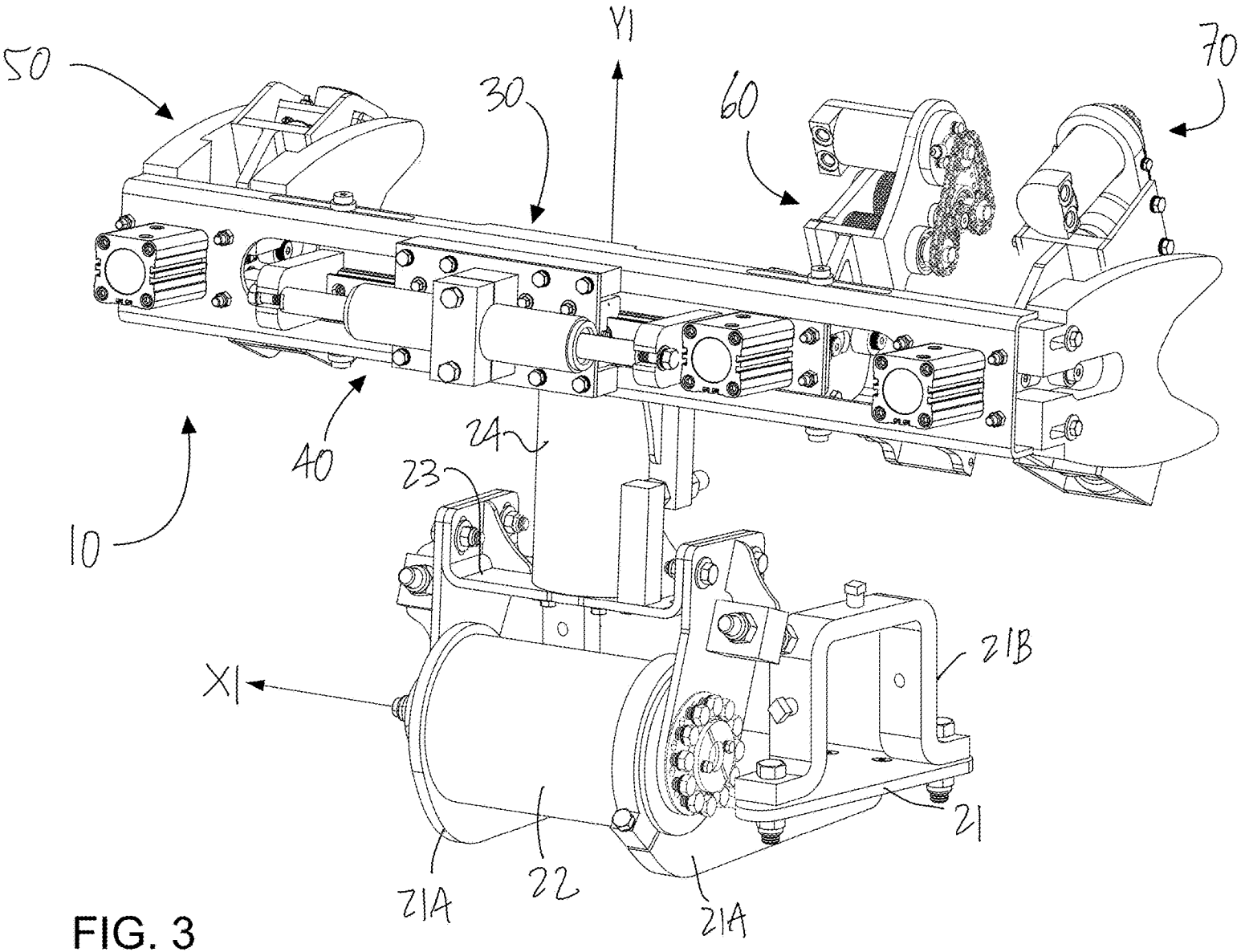
FIG. 3 is a rear perspective view of the rod handler apparatus of FIG. 1.

Referring to the drawings and more particularly to FIGS. 1 to 3, a rod handler apparatus in accordance with the present disclosure is generally shown at 10. The rod handler apparatus 10 is of the used in the context of core drilling, and may perform different functions. One such function may be to manipulate outer tubes to assemble or disassemble with an elongated pipe of outer tubes. Another such function may be to manipulate inner tubes to the elongated pipe, or to collection inner tubes from the elongated pipe, the inner tubes accommodating cores. According to an embodiment, the rod handler apparatus 10 is configured to manipulate both inner tubes and outer tubes without having to change implements. The rod handler apparatus 10 may be mounted to a vehicle, to a platform, to a structure, etc. For simplicity, the rod handler apparatus 10 is shown alone, though it can be readily mounted to a supporting vehicle, equipment, structure. Moreover, the rod handler apparatus 10 could have a base 20 thereof modified for the base 20 to be anchored to a supporting environment (e.g., rock, slab), and thus be its own structure.

The rod handler apparatus 10 may have a base 20, a manipulator arm 30, a linear displacement assembly 40, an alignment jaw assembly 50, a low-speed jaw assembly 60, a and a high-speed jaw assembly 70 or any combination thereof. A system may include the rod handler apparatus 10 and the controller 80. The components, devices, systems can have at least the following functions:

The base 20 may be the interface between the rod handler apparatus 10 and the vehicle, equipment or structure. The base 20 supports a remainder of the rod handler apparatus 10 and tubes (i.e., both inner tubes and outer tubes/rods) manipulated by the rod handler apparatus 10 during a handling operation. The base 20 may also actuators for displacing the manipulator arm 30. For example, the manipulator arm 30 may be rotated about axes X1 and Y1 by actuators on the base 20. Stated differently, the base 20 may be viewed as a robotic arm providing degrees of freedom of movement to the manipulator arm 30. In an embodiment, the there are two rotational degrees of freedom, though there may be fewer or more, and/or translational degrees of freedom. As shown below, the degrees of freedom may be actuated. The base 20 may be described as a serial robot arm with two rotational degrees of freedom, or more.

The manipulator arm 30 supports the various jaws of the rod handler apparatus 10, such as the alignment jaw assembly 50, the low-speed jaw assembly 60, and the high-speed jaw assembly 70. The manipulator arm 30 may also support the linear displacement assembly 40 that may displace the low-speed jaw assembly 60 in a direction parallel to axis X2.

The linear displacement assembly 40 actuates a displacement of the low-speed jaw assembly 60 in a direction parallel to axis X2. The displacement may result in a low-speed translation of the tube concurrently with the rotation about rotational axis X2.

Figure 24:
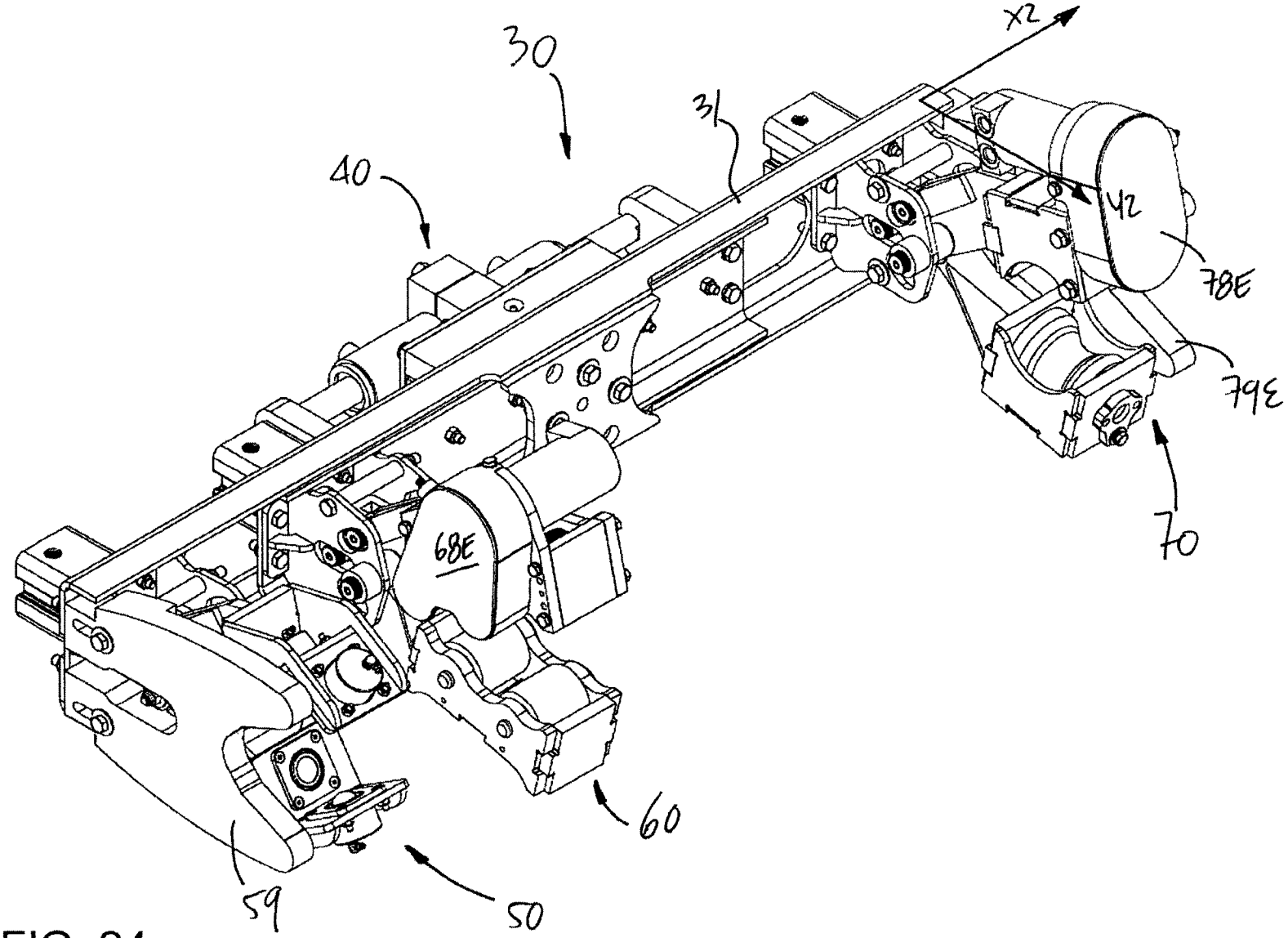
FIG. 24 is a perspective view of a manipulator arm with various jaws of the rod handler apparatus of FIG. 1, in accordance with another embodiment of the present disclosure.

The alignment jaw assembly 50 may be fixed on the manipulator arm 30. During handling operation, the alignment jaw assembly 50 is in close proximity to a proximal end of a rod, in which an outer tube is present, to ensure that the tube manipulated by the manipulator arm 30 is aligned with the elongated rod for threaded coupling between them. The alignment jaw assembly 50 may operate concurrently the tube with the low-speed jaw assembly 60 or the high-speed jaw assembly 70, during low speed maneuvers or high speed maneuvers, respectively. In an embodiment, the alignment jaw assembly 50 is located distally to the proximal end of the rod, while the high-speed jaw assembly 70 is proximal to the proximal end of the rod. Such a configuration is shown in FIG. 24.

The low-speed jaw assembly 60 is tasked with imparting a rotation to a outer tube supported by the manipulator arm 30, in the low speed maneuver, for the threaded coupling with the elongated rod. The rotation of the outer tube is on itself, i.e., about its rotational axis X2.

The high-speed jaw assembly 70 is used for the high speed maneuver of the manipulator arm 30, in which the tube (inner or outer) is translated in the direction parallel to the axis X2, at a higher speed. For example, the high-speed jaw assembly 70 displaces the outer tube to bring it into close proximity with the elongated rod, at high speed, low precision, and the linear displacement assembly 40 and low-speed jaw assembly 60 then handle the low speed precise coupling of the outer tube with the elongated rod. The high-speed jaw assembly 70 may also displaces an inner tube to feed it into the elongated rod. Likewise, the high-speed jaw assembly 70 may displace the outer tube to move it away from the elongated rod, at high speed, low precision, after the linear displacement assembly 40 and low-speed jaw assembly 60 performed the low speed precise uncoupling of the outer tube with the elongated rod.

A controller 80 may be operatively connected to the various motors of the rod handler apparatus 10. The controller 80 may include a one or more processing units and transitory computer-readable memory communicatively coupled to the processing unit and comprising computer-readable program instructions executable by the processing unit for operating the rod handler apparatus 10 in the manner described herein.

Referring concurrently to FIGS. 1 to 3, the base 20 is shown with its components in the 20*s*. The base 20 have a base plate 21 supporting a motor 22, for example by a pair of clamps 21A. Other options are also possible, such as engine mounts, brackets, etc. The motor 22 provides a rotational actuation about axis X1. The base plate 21 is shown as supporting U-shaped connectors 21B by which the base 20 may optionally be mounted on a rail for translation displacement along direction X1. A bracket 23 may be connected to the motor 22, such that a rotational output of the motor 22, in the form of a rotation about axis X1, results in a concurrent rotation of the bracket 23. In an embodiment, the bracket 23 is U-shaped to be adequately connected to the output of the motor 22. Other components may be present, including bearings. In an embodiment, the motor 22 has a through shaft with the bracket 23 connected to opposed ends of the shaft. In another embodiment, the bracket 23 is connected to the shaft of the motor 22 at one end and to an idler shaft/bearing at another end.

A motor 24 is mounted to the bracket 23. The arrangement of FIGS. 1-3 may thus be said to be serial as the motors 22 and 24 are serially arranged. However, other arrangements are contemplated, including a parallel arrangement. The motor 24 provides a rotational actuation about axis Y1. In an embodiment, while optional, rotational axes X1 and Y1 are perpendicular and intersect one another. In another embodiment, while optional, a projection of the rotational axis Y1 on a plane in which rotational axis X1 lies is perpendicular to the rotational axis X1. An angled bracket 25 may be rotationally mounted to the motor 24, such that the motor 24 may rotate the bracket 25 about rotational axis Y1. The angled bracket 25 may have a connection plate 25A that is generally parallel to the rotational axis Y1. In such an arrangement, the angled bracket has the connection plate 25A at more or less 90 degrees relative to a motor plate 25B, by which the bracket 25 is connected to the motor 24. The connection plate 25A is present for the connection of the manipulator arm 30 to the base 20.

Consequently, the manipulator arm 30 may be rotated about axes X1 and Y1, by the respective actuation of the motors 22 and 24. In an embodiment, the base 20 may provide only one rotational degree of freedom (DOF), whether it be about axis X1 or axis Y1. In yet another embodiment, an additional translational DOF may be provided, by translational movement of the base 20 via the base plate 21. The translational DOF may be in a direction parallel to the rotational axis X1, although this may only be an option. The translational DOF may be with present in a configuration of the base 20 providing one rotational DOF (about rotational axis X1 or axis Y1), or both rotational DOFs. The presence of two rotational DOFs may enable a use of the rod handler apparatus 10 to have access to vertical tubes, and this may facilitate their manipulation from an ergonomic standpoint. In yet another embodiment, the base 20 is a fixed post or structure with connection plate for connection of the manipulator arm 30 thereto. In such an embodiment, the base 20 provides no DOF.

Figure 4:
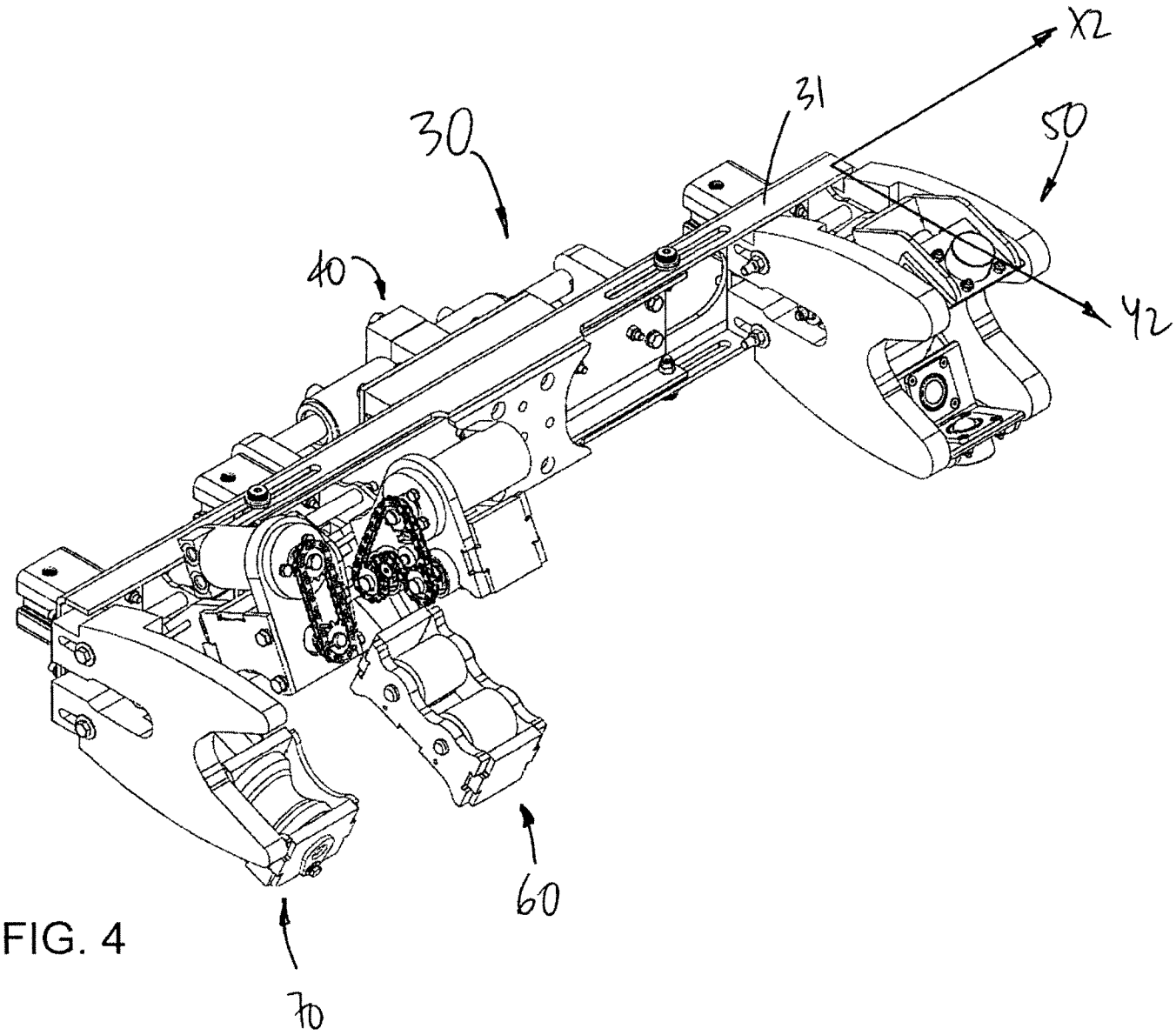
FIG. 4 is a perspective view of a manipulator arm with various jaws of the rod handler apparatus of FIG. 1.
Figure 5:
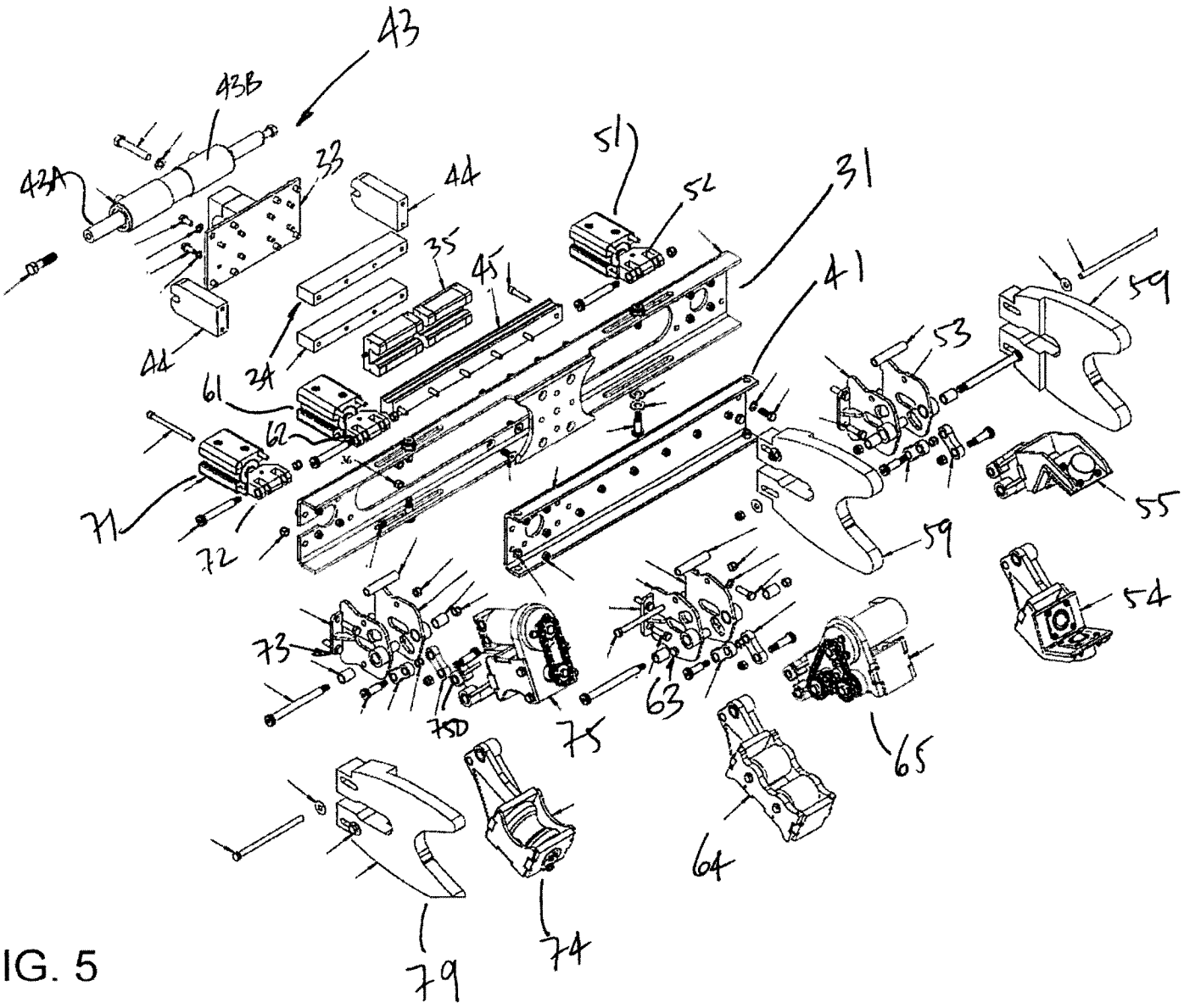
FIG. 5 is an assembly view of the manipulator arm with various jaws of FIG. 4.
Figure 7:
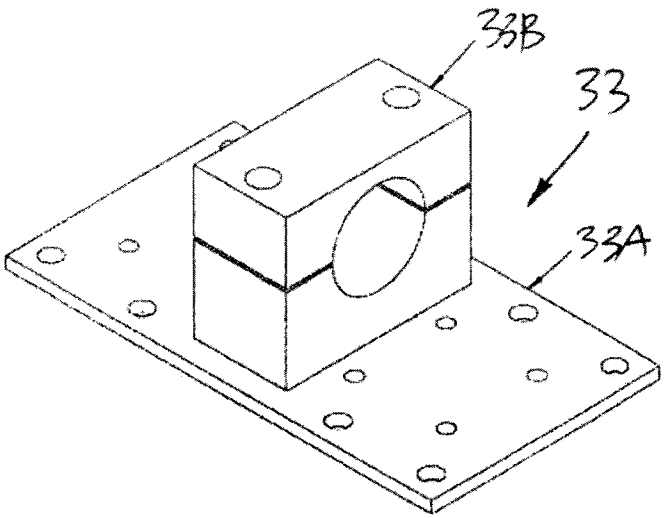
FIG. 7 is a perspective view of an exemplary actuator mount of the manipulator arm of FIG. 5.
Figure 6:
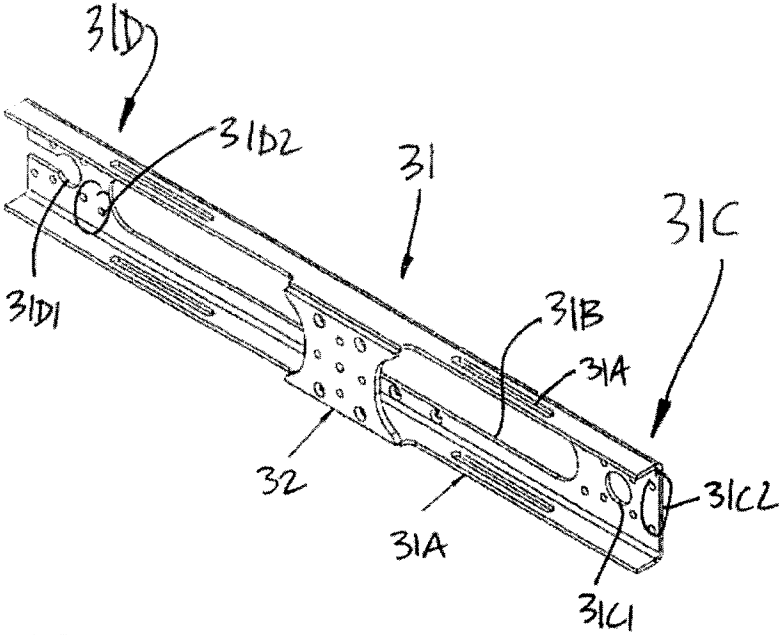
FIG. 6 is a perspective view of a beam of the manipulator arm of FIG. 5.

Referring to FIGS. 4 and 24, two different configurations of the manipulator apparatus 30 as shown. The two configurations differ by the reversed positions of the alignment jaw assembly 50 and the high-speed jaw assembly 70. In the embodiment of FIG. 4, the alignment jaw assembly 50 is closer to the proximal end of the rod. In FIG. 24, it is the high-speed jaw assembly 70 that is closer to the proximal end of the rod. FIGS. 1-3 and 5 show the rod handler apparatus 10 supporting the manipulator arm 30 of the configuration of FIG. 4, but the configuration of FIG. 24 could be used in similar manner in the rod handler apparatus 10, and thus include or not the base 20. However, the numerous components described herein are generally the same in both configurations of the manipulator apparatus 30, and thus the following description applies to both configurations. Referring concurrently to FIGS. 5-7, the manipulator arm 30 is shown as having a beam 31. The beam 31 is the structural component of the manipulator arm 30, as the various jaws and the linear displacement assembly 40 are mounted to the beam 31.

With reference to FIG. 6, the beam 31 is shown in greater detail, along with a connection plate 32 mounted thereon. For example, the connection plate 32 is welded to the beam 31 among possibilities (e.g., integral, brazing, molding, etc). The connection plate 32 is used for the connection of the manipulator arm 30 to the connection plate 25A of the base 20, for example with various fasteners, such as blots, welding, etc. In an embodiment, the connection plate 25A is connected directly to the beam 31. Parts of the beam 31 are numbered in FIG. 6 only to avoid an excessive number of reference numerals in FIGS. 1 to 5. The beam 31 may be a C-section beam. Other sliding joint configurations are possible, alternatively. Guidance slots 31A may be defined in upper and lower flanges of the beam 31 to lock a slider beam in the beam 31, as shown hereinafter. The guidance slots 31A are optional and may not be present, for instance in FIG. 24. A central clearance 31B may be located in a main face of the beam 31. The central clearance 31B is defined in the beam for components to project through the beam 31. For example, as described hereinafter, the low-speed jaw assembly 60 may be connected to the linear displacement assembly 40 and must therefore be connected to it, via the central clearance 31B. At a distal end 31C of the beam 31, a central hole 31C1 may be present, along with satellite holes 31C2, for the connection of the alignment jaw assembly 50 to the beam 31. At a proximal end 31D of the beam 31, a central hole 31D1 may be present, along with satellite holes 31D2, for the connection of the high-speed jaw assembly 70 to the beam 31. The configurations of the ends 31C and 31D are merely provided as examples, as other configurations may be used as well.

Referring concurrently to FIGS. 5 and 7, an actuator mount 33 is connected to the beam 31. With reference to FIG. 7, the actuator mount 33 may have a plate 33A and a clamp 33B. The plate 33A may be connected directly to the beam 31, or may include spacers 34 (FIG. 5). The spacers 34 may be an integral part of the plate 33A as well. The clamp 33B may be a two-part clamp with a central bore, by which a component may be clamped. In an embodiment, the central bore of the clamp 33B is circular, and the component clamped therein is a linear actuator of circular cross-section. Standard threaded fasteners, such as screws, bolts and nuts, may be used to exert clamping pressure. Referring to FIG. 5, carriages 35 are secured to the plate 33A, and face toward the clearance 31B. The carriages 35 are shown as a pair, but a single carriage 35 may also be present. The connection plate 32, the actuator mount 33, the spacers 34 and the carriage(s) 35 are all fixed relative to the beam 31.

Figure 8:
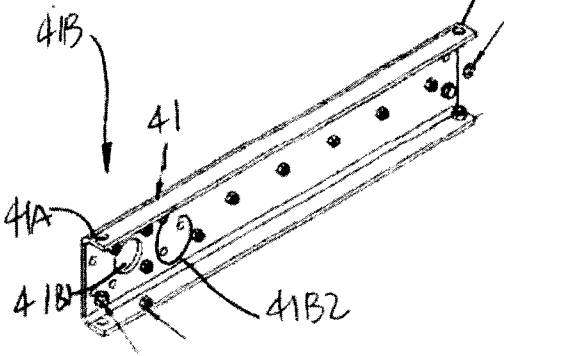
FIG. 8 is a perspective view of an exemplary slider beam of the manipulator arm of FIG. 5.

Referring to FIGS. 5 and 8, the linear displacement assembly 40 includes a slider beam 41. The slider beam 41 may also be a C-section beam, though smaller in dimensions than beam 31. The slider beam 41 is consequently received in the cavity of the beam 31 so as to be translatable in direction X2. Guidance holes 41A may be defined in upper and lower flanges of the slider beam 41 to lock the slider beam in the beam 31, by way of fasteners passing through the guidance slots 31B (FIG. 6). The elongated shape of the guidance slots 31B may guide the translational movement. A reverse arrangement is also contemplated, with guidance slots in the slider beam 41 and guidance holes in the beam 31. However, this is optional, for instance in the case where guidance slots 31B are absent, such as in FIG. 24. The collaboration between the slider beam 41 and beam 31, in addition to other components, may suffice in maintaining the slider beam 41 in translational relation with the beam 31. At a proximal end 41B of the slider beam 41, a central hole 41B1 may be present, along with satellite holes 41B2, for the connection of the low-speed jaw assembly 60 to the slider beam 41.

Figure 10:
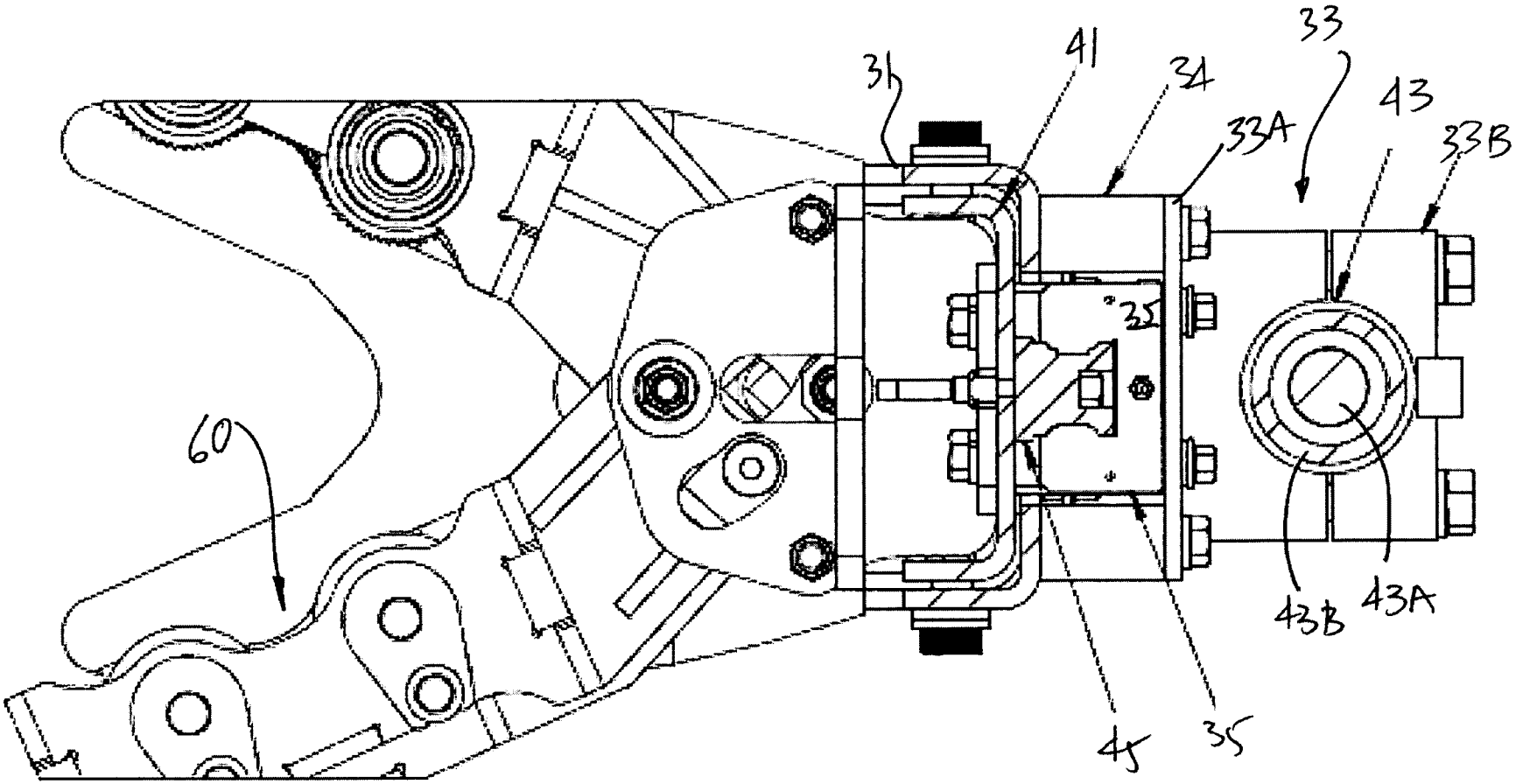
FIG. 10 is a sectional view of a linear displacement assembly on the manipulator arm of FIG. 5.

Referring to FIGS. 5 and 10, the linear displacement assembly 40 may further have a linear actuator 43. The linear actuator 43 may be clamped in the actuator mount 33, to be secured to the beam 31. In an embodiment, the linear actuator 43 may be an electromechanical device, such as ball screw, magnetic, etc. Other embodiments include pneumatic or hydraulic cylinders as well. The linear actuator 43 has shaft 43A projecting from a housing 43B. The housing 43B may have a cross-sectional shape corresponding to that of the clamp 33B. In an embodiment, the shaft 43A projects from both ends of the housing 43B. For example, the shaft 43A may be a worm. Accordingly, the shaft 43A may translate along direction X2 by actuation of the linear actuator 43. Blocks 44 may be the interfaces between the shaft 43A of the linear actuator 43 and the slider beam 41 or a rail 45. The rail 45 is slidingly received in the carriages 35 fixed relative to the beam 31. The rail 45 may also be secured to the beam 41 in the linear displacement assembly 40. Therefore, when the shaft 43A translates, the blocks 44 impart the translational movement to the slider beam 41. The slider beam 41 consequently translates in the beam 31. The cooperation between the carriages 35 and the rail 45 ensures a smooth and precise translation along a direction parallel to X2. In an embodiment, the reverse arrangement is present, with the carriage being part of the linear displacement assembly 40 and the rail being fixed to the structural beam 31. The afore-described arrangement of the manipulator arm 30 and linear displacement assembly 40 results in a translation of the linear displacement assembly 40 relative to the beam 31 and components secured to it. The housing 43B of the linear actuator 43 may be the only component of the linear displacement assembly 40 that is stationary relative to the beam 31.

The various jaws of the manipulator arm 30 may now be described, i.e., the alignment jaw assembly 50, the low-speed jaw assembly 60 and the high-speed jaw assembly 70. In FIG. 4, the alignment jaw assembly 50 is secured to the distal end of the beam 31 and the high-speed jaw assembly 70 is secured to the proximal end of the beam 31, although they could be at other locations. Indeed, as in FIG. 24, the alignment jaw assembly 50 is secured to the proximal end of the beam 31 and the high-speed jaw assembly 70 is secured to the distal end of the beam 31, As they are secured to the beam 31, the alignment jaw assembly 50 and the high-speed jaw assembly 70 are fixed and do not move along the beam 31. In contrast, the low-speed jaw assembly 60 is mounted to the slider beam 41 and may consequently translate with the slider beam 41, along a direction parallel to X2, and back and forth along the beam 31.

Figure 9A:
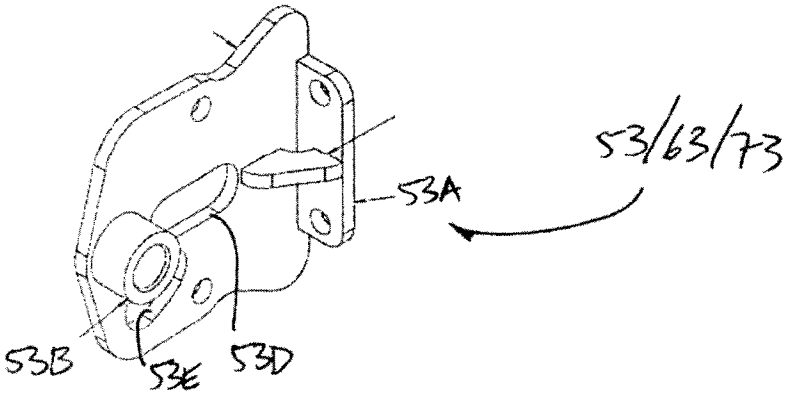
FIG. 9A is a perspective view of an exemplary side plate of jaw assemblies supported by the manipulator arm of FIG. 5.
Figure 11:
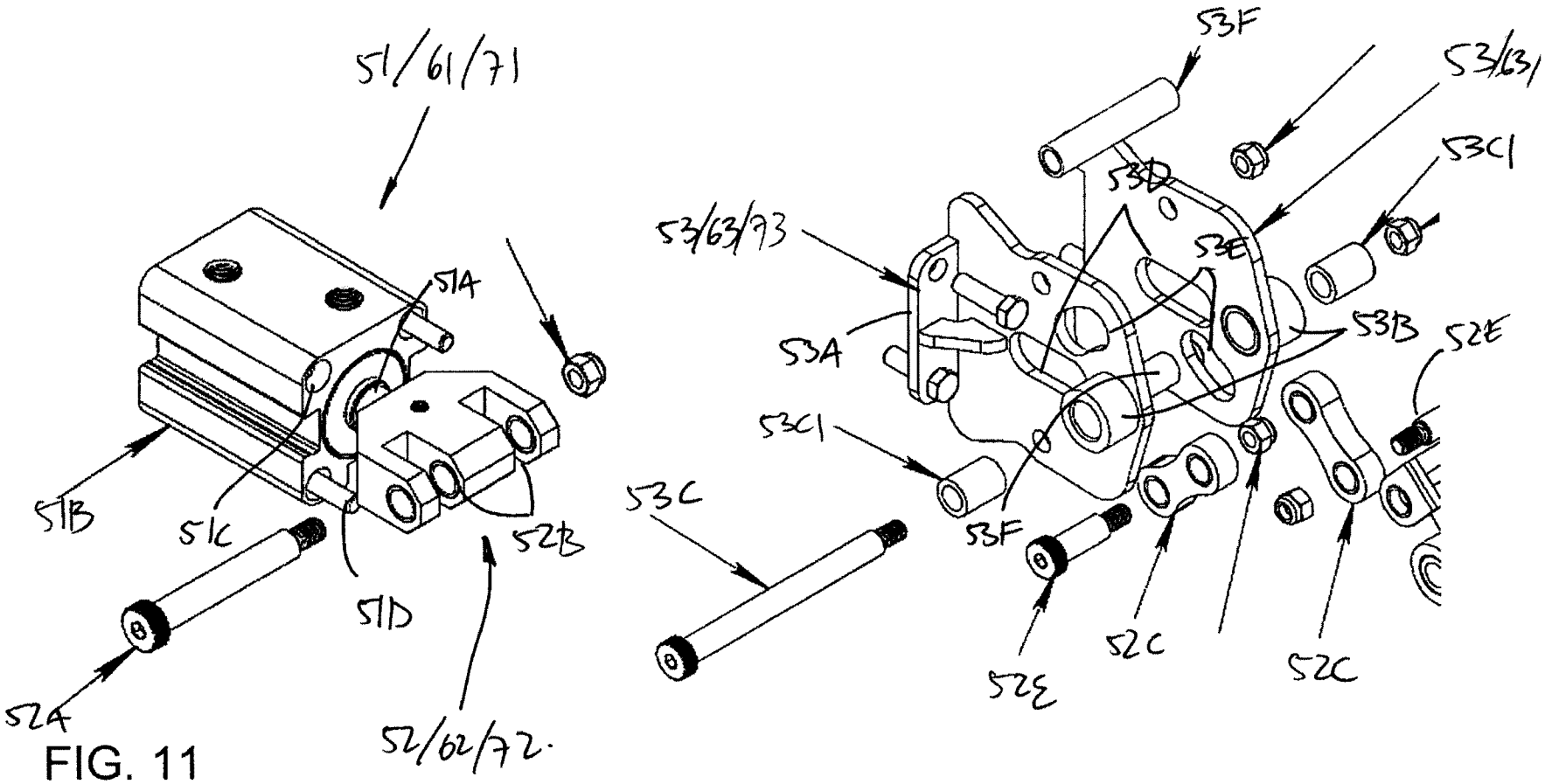
FIG. 11 is an exploded view of an assembly of parts of the jaw assemblies supported by the manipulator arm of FIG. 5.

According to an embodiment, the jaws 50, 60 and 70 have similar parts, which similar parts will be described concurrently. Referring concurrently to FIGS. 5, 9A and 11, the similar parts of the jaws 50, 60 and 70 include a linear actuator 51/61/71, a pivot base 52/62/72, side plates 53/63/73, first jaw 54/64/74, and second jaw 55/65/75. As these parts are generally similar, the following description will only refer to them and their subparts in the 50*s*. The reference numerals in the 60*s* and 70*s* are omitted to avoid an excess of reference numerals in FIGS. 9A and 11. However, if for instance a component is described and shown in the 50*s* in FIGS. 9A and 11, there is an equivalent in the 60*s* and 70*s*, for the low-speed jaw assembly 60 and for the high-speed jaw assembly 70, respectively. For example, though reference will be made and shown for a pivot 52A only, the description also covers a pivot 62A as part of the low-speed jaw assembly 60, and a pivot 72A, as part of the high-speed jaw assembly 70. Hence, continuing with reference to the 50*s* (but covering 60*s* and 70*s*), the linear actuator 51 has a shaft 51A and a housing 51B. In an embodiment, the linear actuator 51 may be an electromechanical device, such as ball screw, magnetic, etc. Other embodiments include pneumatic or hydraulic cylinders as well. The shaft 51A is displaceable in a direction parallel to Y2, to close or open jaws of the alignment jaw assembly 50. The housing 51B is of the type having threaded bores 51C receiving screws 51D, or like threaded fasteners, to secure the housing 51B to the beam 31. In the case of housing 61B, it is secured to the slider beam 41.

Referring to FIGS. 5 and 11, a pivot base 52 is secured to the end of the shaft 51A. The pivot base 52 may include a pivot 52A that is transverse or perpendicular to an axis of the shaft 51A. Slots 52B may also be present on the pivot base, for the connection of linkages 52C to the pivot 52A. The pivot 52A may extend beyond the sides of the pivot base 52, and thus may have projecting ends. The linkages 52C are similar to a chain link, with a pair of holes defined in each of the linkages 52C. Free holes of the linkages 52C, i.e., the ones that do not receive the pivot 52A, may receive therein a guide pin 52E. The guide pin 52E is illustrated as a nut and bolt with a smooth shaft section, but other configurations are possible, such as a screw, a sleeve on bolt or nut, etc.

Figure 9B:
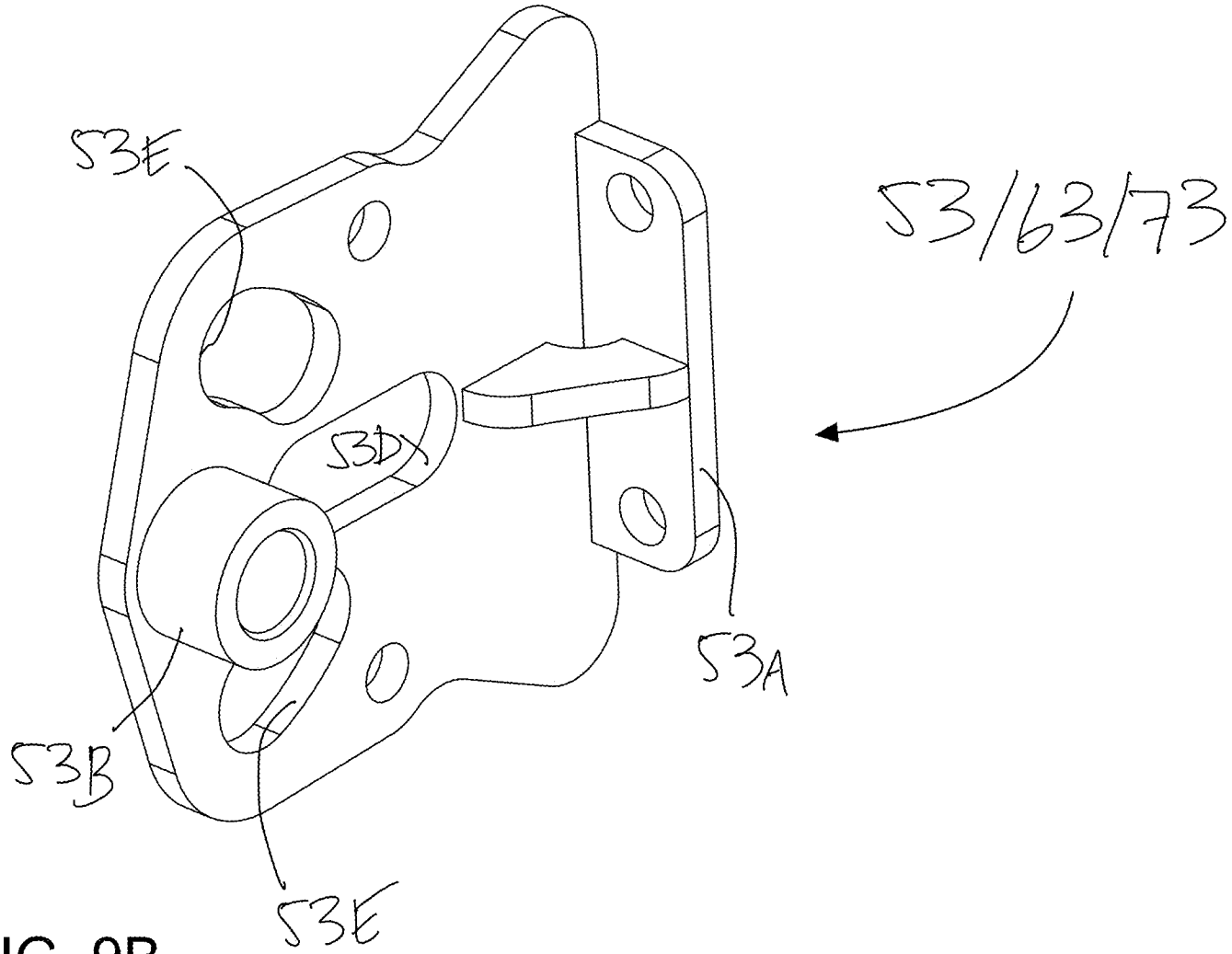
FIG. 9B showing an alternative embodiment of the side plate of jaw assemblies supported by the manipulator arm of FIG. 5.

Referring to FIGS. 9A and 11, side plates 53 form the structure of the jaw assembly 50. The side plates 53 also operatively support the components of the alignment jaw assembly 50, to guide their movements. The alignment jaw assembly 50 may have a pair of side plates 53. In an embodiment, the side plates 53 are the same piece, though rotated 180 degrees. The side plates 53 may have end flanges 53A by which they may be fixed to the beam 31. In the case of side plates 63, they are secured to the slider beam 41. The side plates 53 may have a pivot housing 53B. The pivot housing 53B may be in the form of a cylindrical projection from a plane of the plates 53, to house a pivot 53C. Hence, the pivot housing 53B may be said to be a journal for the pivot 53C. The pivot 53C may be a fastener, such as a bolt among other possibilities. In an embodiment, low-friction sleeves 53C1 may be on the pivot 53C to ease the pivoting of the jaws, as the jaws will be rotatably mounted to the pivot 53C. The side plates 53 may also define straight guide slots 53D. The straight guide slots 53D may receive therein the projecting ends of the pivot 52A. Therefore, the straight guide slots 53D may ensure that the pivot base 52 maintains a constant orientation relative to the beam 31 when it translates as a response to an actuation of the linear actuator 51. The side plates 53 may also define a curved guide slot 53E. The curved guide slots 53E may receive therein a projection portion of the guide pin 52E. The sliding cooperation of the guide pin 52E may guide the movement of the jaws. As observed, each side plate 53 has a single curved guide slot 53E, but it is possible to have pairs of curved guide slots 53E in each side plate 53 to support the guide pins 52E at opposed ends. This is shown in FIG. 9B, for example. In such a scenario, both side plates 53 of a same jaw assembly may be the same.

Referring to FIG. 11, the side plates 53 are spaced apart by spacers 53F, whereby a free volume or gap is defined between the side plates 53. As the side plates 53 support the jaws in the free volume, the spacers 53F may add to the structural integrity of the assembly. In an embodiment, the side plates 53 may be integrally connected as part of a U-shaped bracket.

Figure 12:
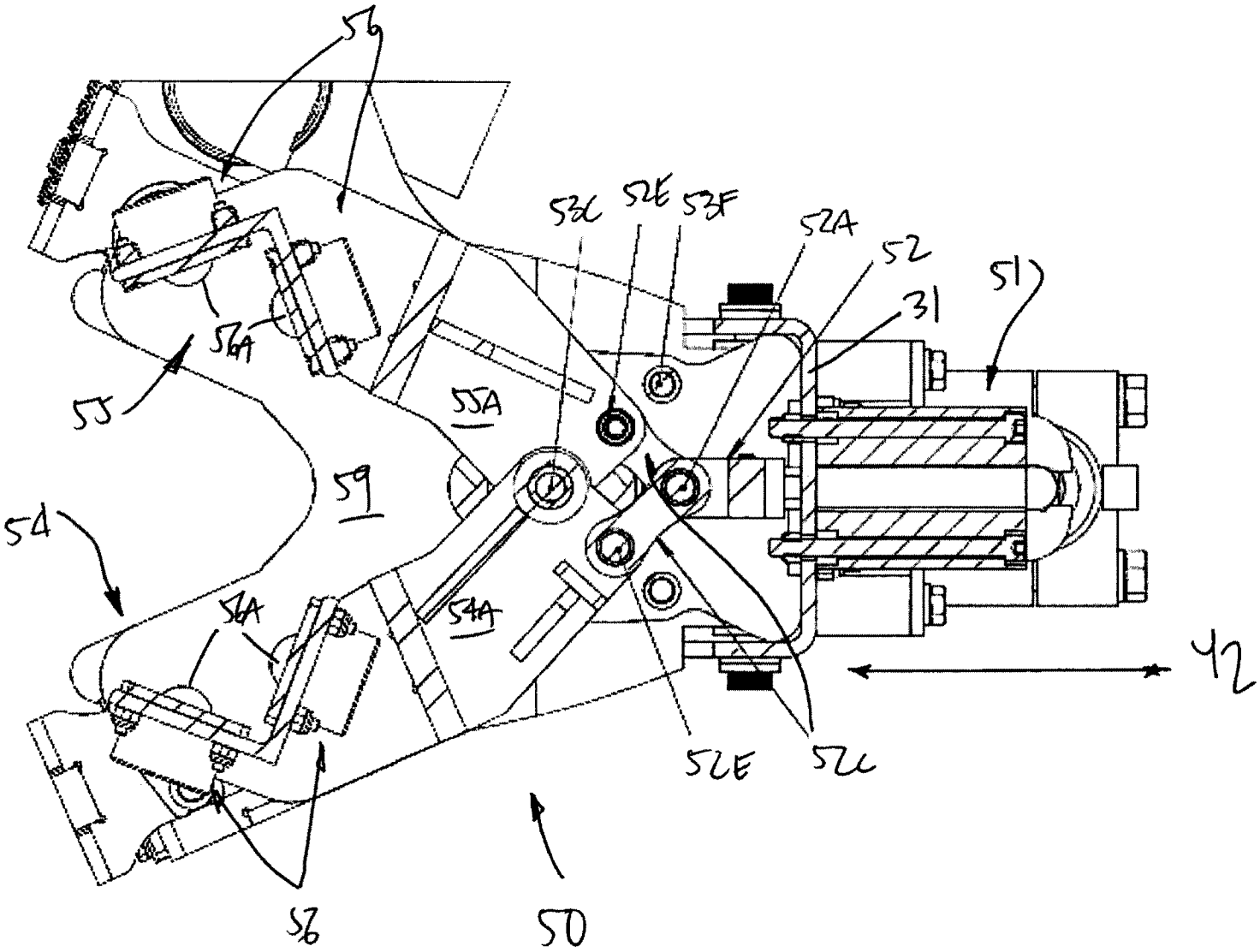
FIG. 12 is a sectional view of an alignment jaw assembly on the manipulator arm of FIG. 5.

Referring now to FIG. 12, first jaw 54 and second jaw 55 are shown pivotally connected to the side plates 53 (one shown). The first jaw 54 and the second jaw 55 are concurrently pivoted about the pivot 53C. As explained hereinafter, the first jaw 54 and the second jaw 55 are also connected to a respective one of the linkages 52C. Therefore, a pushing or pulling action from the linear actuator 51 results in a translation of the pivot 52A, for instance as guided by the straight guide slots 53D, in a cam and slot or guide and follower manner. The linkages 52C, with guide pins 52E received in the curved guide slots 53E may then cause a closing or opening action of the jaws 54 and 55, which rotate about the pivot 53C. Accordingly, the assembly of the pivot base 52 and side plates 53 converts a translational output of the linear actuator 51 into a concurrent rotational action of the jaws 54 and 55. The jaws 54 and 55 concurrently move toward or away from one another. In another embodiment, only one of the jaws 54 or 55 moves while the other is immobile. Again, the above paragraphs apply to linear actuator 51/61/71, pivot base 52/62/72, side plates 53/63/73, first jaw 54/64/74, and second jaw 55/65/75.

Figure 14:
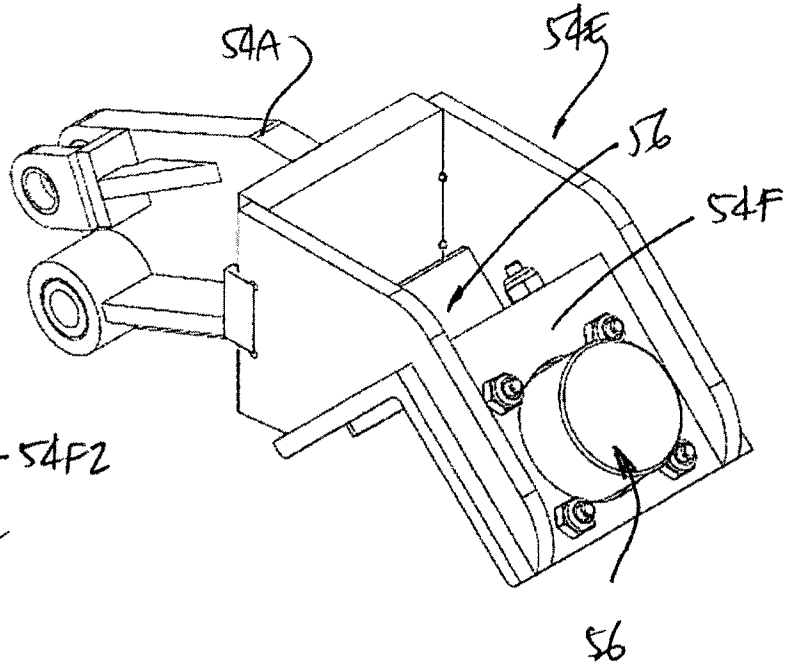
FIG. 14 is a perspective view of one of the jaws of the alignment jaw assembly of FIG. 12.
Figure 13:
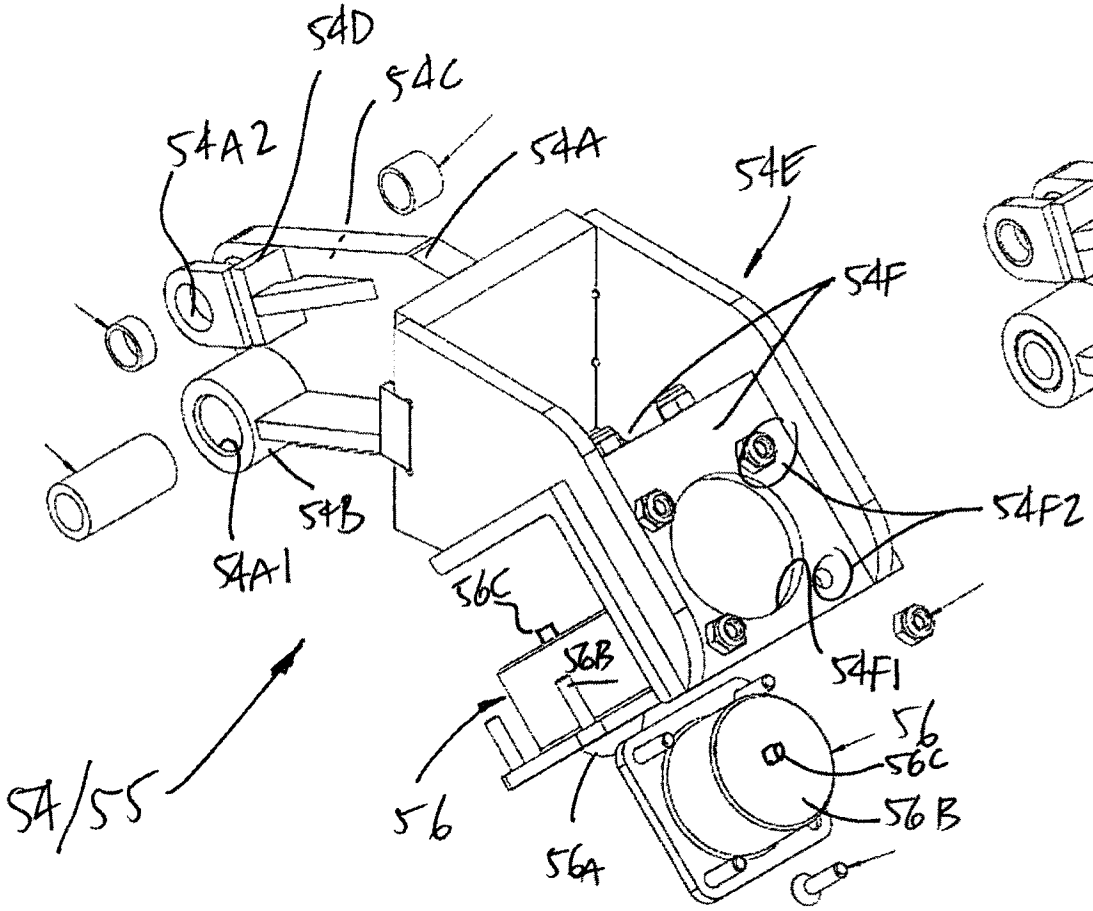
FIG. 13 is an exploded view of one of the jaws of the alignment jaw assembly of FIG. 12.

Referring to FIGS. 13 and 14, the first jaw 54 of the alignment jaw assembly 50 is shown. The second jaw 55 of the alignment jaw assembly 50 may be the same or similar in configuration, whereby the following paragraphs focus on the first jaw 54. However, the description of the first jaw 54 extends to the second jaw 55. The jaw 54 has an arm 54A with bores 54A1 and 54A2. The bore 54A1 is the one that receives therein the pivot 53C. The bore 54A1 may be defined in a projection 54B (shown as a cylindrical projection). The projection 54B may increase the axial length of the bore 54A1 and hence add stability to the pivoting interconnection between the jaw 54 and the pivot 53C. The projection 54B may be on a single side of the arm 54A, for the arm 54A to define a flat plane 54C, such that the jaws 54 and 55 have their flat planes 54C and 55C against one another when assembled as in FIG. 12. Bore 54A2 may be in a bracket-shaped support 54D (e.g., U bracket) for the linkage 52C to be received in a gap of the bracket-shaped support 54D. The guide pin 52E passes through the bore 54A2 to then project into the curved guide slot 53E (FIG. 11).

The jaw 54 may further have a casing 54E at the end of the arm 54A. The casing 54E receives the tube interfaces 56 of the jaw 54. The casing 54E may be box-shaped, with a pair of support plates 54F. Central holes 54F1 may be defined in the support plates 54F. Satellite holes 54F2 may also be present, for fasteners to be used to fastened the tube interfaces 56 to the support plates. In an embodiment, the support plates 54F may be perpendicular to one another, although other angles may be used depending on the sizes of the tubes.

The tube interfaces 56 may be in the form of balls 56A in their housings 56B. The balls 56A are held in their housings 56B, but project partially out, as observed from FIG. 12. A port 56C may be present, though optional, for a lubricant such as grease or oil to be fed to the housing 56B and hence reach the ball 56A. The orientation of the support plates 54F relative to one another is such that parts of the balls 56A projecting out of the housings 56B, through the central holes 54F1, face each other. Accordingly, a tube, whether an inner tube or outer tube, received in between the jaws 54 and 55 will be in contact with the four balls 56A. Moreover, a position of a central axis of a tube received in the closed jaws 54 and 55 is predictable, and this may assist in having the manipulator arm 30 properly positioned relative to the elongated rod, for threaded coupling. The tube interfaces 56 may not be powered in that they allow the tube to move along their surfaces by rolling. Stated differently, the tube interfaces 56 may be idlers. While the tube interface 56 used with the jaws 54 and 55 is described as including balls, other embodiments are considered, including rollers. The balls 56A are convenient in that the different tube sizes may be used with the jaws 54 and 55 featuring the tube interface 56. The tube interface 56 may be said to be passive, as the balls 56A are idlers, and their rotations are not actuated. Sliding pads or surfaces could be used instead of rollers in an embodiment.

Shield plates 59 may be present, as shown in FIG. 5, to project the alignment jaw assembly 50 from contacts during manipulations. The shield plates 59 may be made of a heavy duty material. In an embodiment, the shield plates 59/79 may only be at the proximalmost and distalmost end of the rod manipulator 30, as shown in FIG. 24. The configuration of FIGS. 4 and 5 could also have only two shield plates, i.e., one 59 and one 79, with the shield plate 59 of the alignment jaw assembly 50 facing the low-speed jaw assembly 60 being absent.

Figure 16:
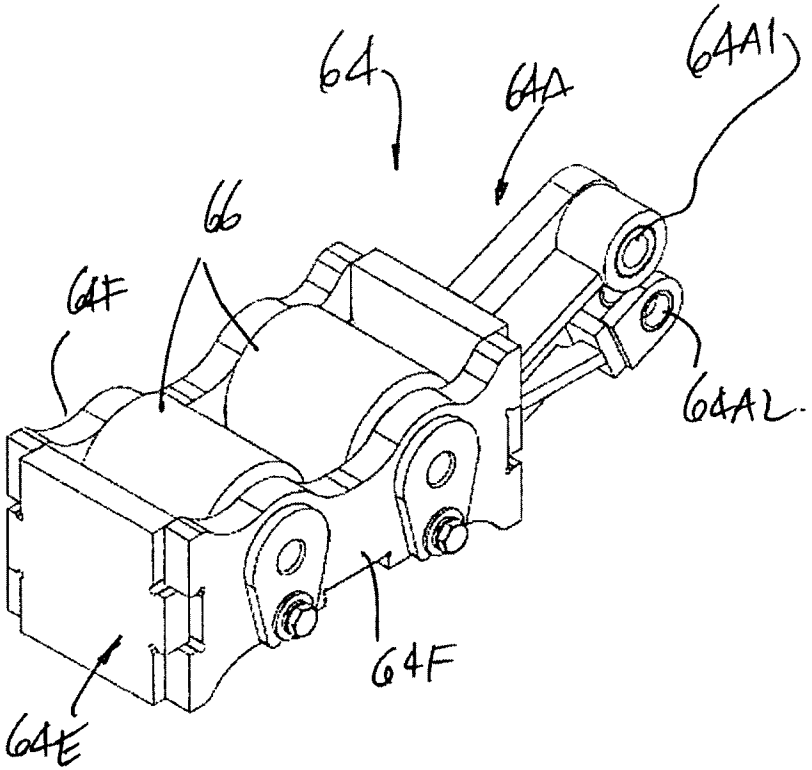
FIG. 16 is a perspective view of the first jaw of the low-speed jaw assembly of FIG. 15.
Figure 15:
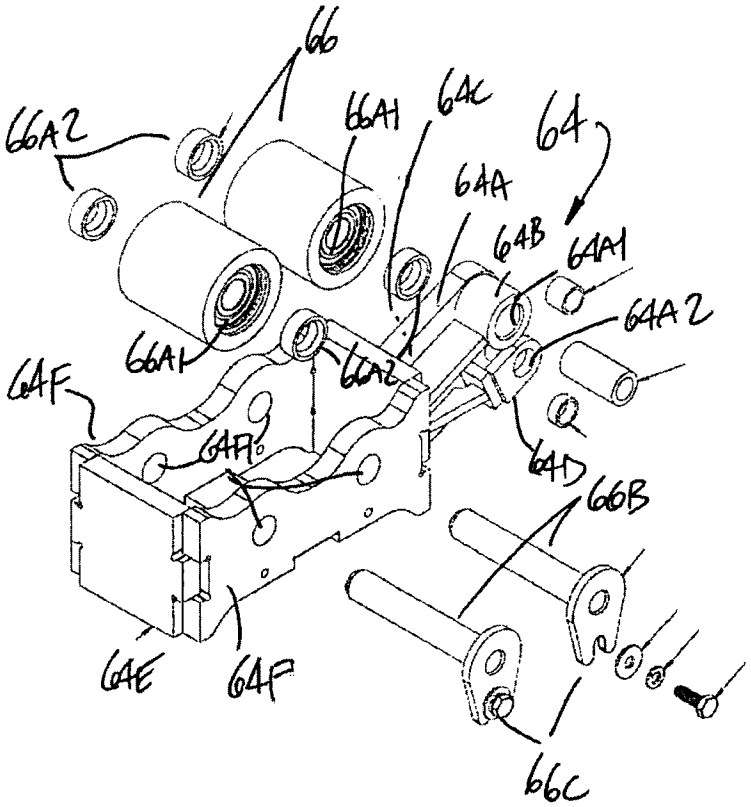
FIG. 15 is an exploded view of the first jaw of a low-speed jaw assembly of the manipulator arm of FIG. 5.

Referring to FIGS. 15 and 16, the first jaw 64 of the low-speed jaw assembly 60 is shown. The jaw 64 has an arm 64A with bores 64A1 and 64A2. The bore 64A1 is the one that receives therein the pivot 63C. The bore 64A1 may be defined in a projection 64B (shown as a cylindrical projection). The projection 64B may increase the axial length of the bore 64A1 and hence add stability to the pivoting interconnection between the jaw 64 and the pivot 63C. The projection 64B may be on a single side of the arm 64A, for the arm 64A to define a flat plane 64C, such that the jaws 64 and 65 have their flat planes 64C and 65C against one another when assembled as in FIG. 4. Bore 64A2 may be in a bracket-shaped support 64D (e.g., U bracket) for the linkage 62C to be received in a gap of the bracket-shaped support 64D. The guide pin 62E passes through the bore 64A2 to then project into the curved guide slot 63E (with FIG. 11 exemplifying this, for the alignment jaw assembly 50).

The jaw 64 may further have a casing 64E at the end of the arm 64A. The casing 64E receives the tube interfaces 66 of the jaw 64. The casing 64E may be box-shaped, with a pair of support plates 64F facing each other with a cavity between them. Shaft holes 64F1 may be defined in the support plates 64F. In an embodiment, the support plates 64F may be parallel to one another.

The tube interface 66 may be in the form of cylindrical rollers 66A, or alternatively, wheels, mounted onto their shafts 66B. The rollers 66A are held in the cavity of the casing 64E so as to be rotatable about their shafts 66B, for instance via bearings 66A1 therein. Spacers 66A2 may optionally be present to provide a clearance between the rollers 66A and the casing 64E, and hence avoid rubbing contact or friction therebetween. The support plates 64F are shaped and contoured such that parts of the rollers 66A project out of the casing 64E. Accordingly, an outer tube received in between the jaws 64 and 65 will be in contact with the two cylindrical rollers 66A. The tube interface 66 may not be powered in that it allows the outer tube to rotate on itself along the surfaces of the rollers 66A by rolling. While the tube interface 66 used with the jaw 64 is described as including rollers, other embodiments are considered, including balls. The rollers 66A are convenient in that the different tube sizes may be used with the jaw 64 featuring the tube interface 66. The shafts 66B may have a connector 66C projecting eccentrically from their ends. This is one of different arrangements considered to connect the shafts 66B to the casing 64E. The arrangement of FIGS. 15 and 16 is relatively small and hence well suited for the jaw 64 due to space constraints.

Figure 17:
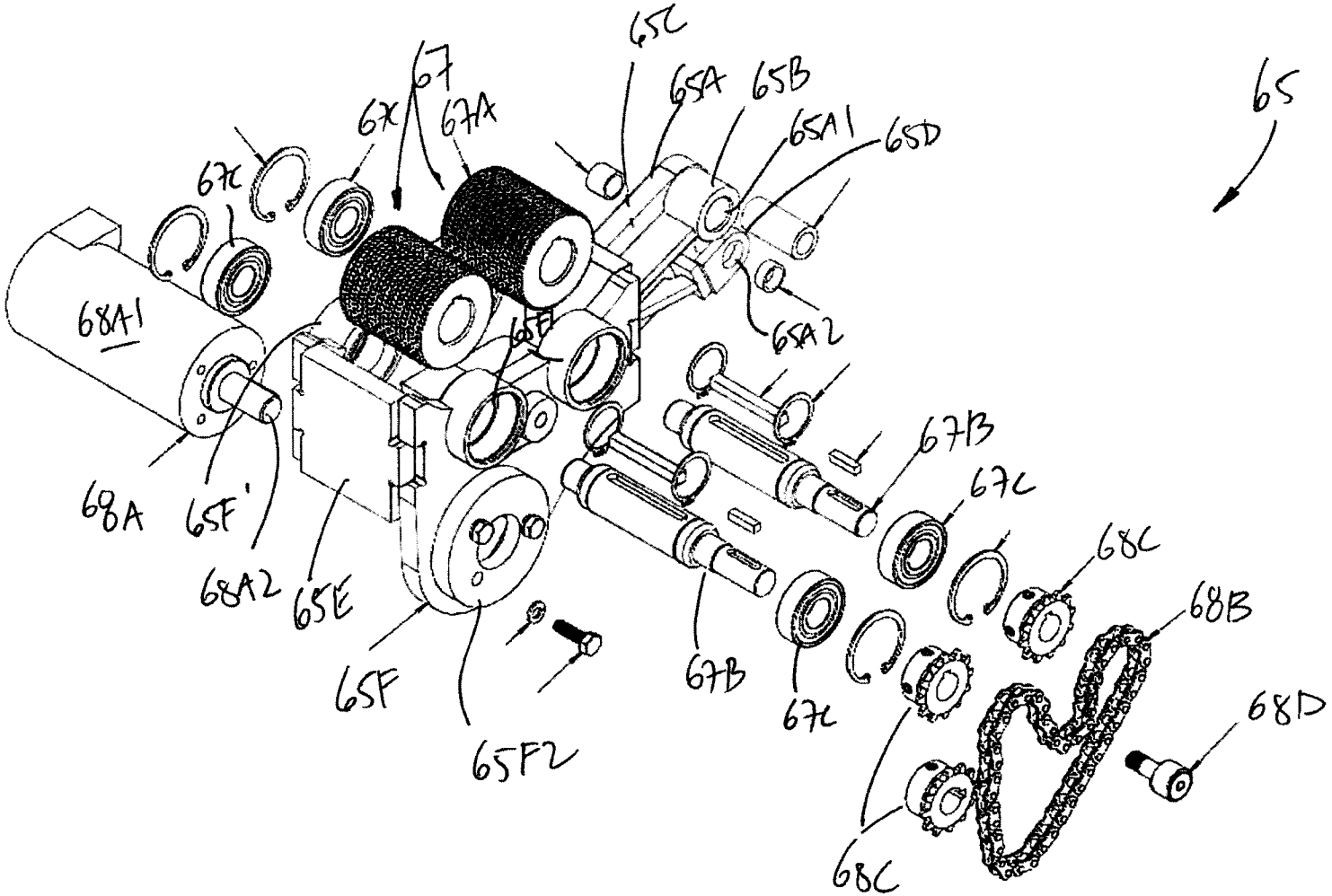
FIG. 17 is an exploded view of one of the second jaw of the low-speed jaw assembly of the manipulator arm of FIG. 5.
Figure 18:
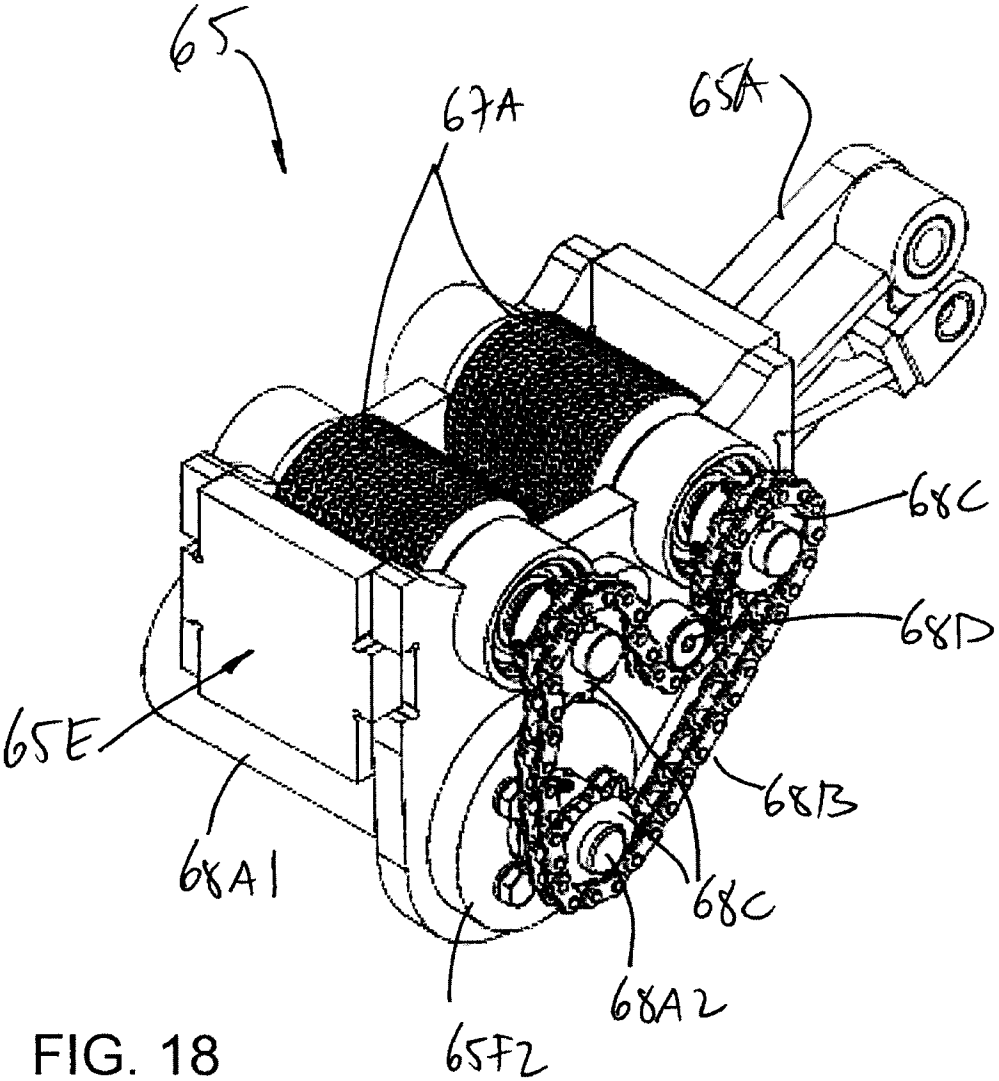
FIG. 18 is a perspective view of the second jaw of the low-speed jaw assembly of FIG. 17.

Referring to FIGS. 17 and 18, the second jaw 65 of the low-speed jaw assembly 60 is shown. The second jaw 65 may have many parts in common with the first jaw 64, whereby a similar numbering of components is used, with the difference that components of the second jaw 65 are listed under 65, while components of the first jaw 64 are listed under 64. For example, the second jaw 65 has an arm 65A with bores 65A1 and 65A2, similar to the arm 64A with bores 64A1 and 64A2. The bore 65A1 is the one that receives therein the pivot 63C. The bore 65A1 may be defined in a projection 65B (shown as a cylindrical projection, as an example). The projection 65B may increase the axial length of the bore 65A1 and hence add stability to the pivoting interconnection between the jaw 65 and the pivot 63C. The projection 65B may be on a single side of the arm 65A, for the arm 65A to define a flat plane 65C, such that the jaws 64 and 65 have their flat planes 64C and 65C against one another when assembled as in FIG. 4. Bore 65A2 may be in a bracket-shaped support 65D (e.g., U bracket) for the linkage 62C to be received in a gap of the bracket-shaped support 65D. The guide pin 62E passes through the bore 65A2 to then project into the curved guide slot 63E (with FIG. 11 exemplifying this, for the alignment jaw assembly 50).

The second jaw 65 may further have a casing 65E at the end of the arm 65A. The casing 65E receives the tube interface 67 of the jaw 65. Here, the tube interface 67 used in the second jaw 65 is different from the tube interface 66 of the first jaw 64, notably because the tube interface 67 is driven, i.e., it is powered to induce a rotation of an outer tube clamped in the low-speed jaw assembly 60.

The casing 65E may be box-shaped, with a pair of support plates 65F and 65F' facing each other with a cavity between them, in which components of the tube interfaces 67 may be received. The support plates 65F may differ from the support plates 64F of the first jaw 64, so as to support transmission features for receiving a drive. In an embodiment, the support plates 64F may be parallel to one another. The support plates 65F and 65F' may both have bearing receptacles 65F1 to hold bearings 67C that will support the shaft 67B of the tube interface 67, if present. The support plate 65F may have a greater size than the support plate 65F', so as to feature a motor mount 65F2.

The tube interface 67 may be in the form of cylindrical rollers 67A mounted onto their shafts 67B. A spline connection, a key and slot (as shown), etc, may be present between the cylindrical rollers 67A and the respective shafts 67B to ensure concurrent rotation. The cylindrical rollers 67A may also be wheels, as an alternative. The rollers 67A may have surface features to ensure slipless contact between the rollers 67A and an outer tube against the surfaces of the rollers 67A, as the rollers 67A impart a rotation to the outer tube they support. As the surface rollers 67A must apply torque to the outer tubes, the surface of the rollers 67A may have spikes, an abrasive, etc, as the surface of the outer tubes need not remain smooth. The rollers 67A are held in the cavity of the casing 65E so as to be rotatable with their shafts 67B. The support plates 65F and 65F' are shaped and contoured such that parts of the rollers 67A project out of the casing 65E. Accordingly, an outer tube received in between the jaws 64 and 65 will be in contact with the rollers 66A and rollers 67A. The rollers 67A are convenient in that different tube sizes may be used with the jaw 65 featuring the tube interface 67.

The shafts 67B may project beyond the support plate 65F to be connected to a drive system 68. The drive system 68 may include a motor 68A. The motor 68A may have its housing 68A1 received in the motor mount 65F2, among other possibilities. In such an arrangement, the shaft 68A2 of the motor 68A projects beyond the support plate 65F. The motor 68A may be a bi-directional motor, i.e., it may rotate in both directions. In an embodiment, an electric motor is used, but other motor types may be used, include hydraulic and pneumatic. The drive system 68 may further include a transmission to couple the shaft 68A2 of the motor 68A to the rollers 67A. According to an embodiment, the shaft 68A2 of the motor 68A is parallel to the shafts 67B, though other arrangements may be present as well. The motor 68A is located over the rollers 67A in a compact arrangement of the components of the tube interface 67. The transmission may therefore include a chain 68B and sprockets 68C fixed to the shaft 68A2 of the motor 68A and to the shafts 67B of the rollers 67A. As the sprockets 68C must rotate with the shafts 67B and 68A2 for transmission of rotation to the rollers 67A, connection means, such as keys and slots (but alternatively threading engagement, splines) may be present. The sprockets 68C may be of different sizes for reduction to occur from the motor 68A to the rollers 67A. An idler 68D may also be present, and be rotatingly connected to the support plate 65F, for instance to define a chain route and/or preserve a suitable tension in the chain 68B. The routing of the chain is such that the rollers 67A rotate in a same direction. A chain guard 68E may be present to conceal the chain and gear transmission, as illustrated in FIG. 24. As alternatives to the transmission of chain 68B and sprockets 68C, intermeshed gears, pulleys-cable sets and the like could be used. In yet another embodiment, the tube interface 67 could have a single roller 67A, or have a single driven roller 67A paired with an idler roller 67A. Two motors could be used, i.e., one for each direction of rotation. The roller(s) 67A have an axis of rotation that is generally parallel to a direction of translation of the tubes, i.e., along axis X2.

Figure 20:
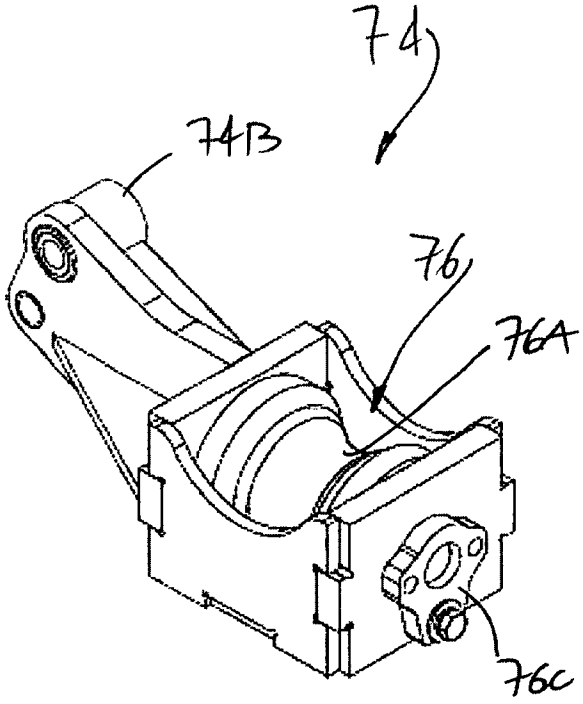
FIG. 20 is a perspective view of the first jaw of the high-speed jaw assembly of FIG. 19.
Figure 19:
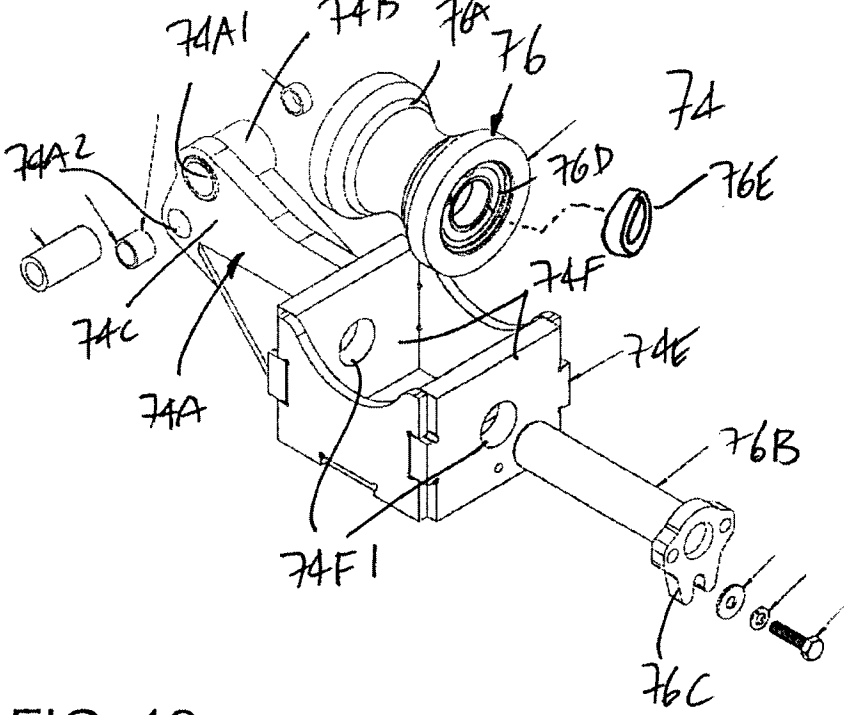
FIG. 19 is an exploded view of the first jaw of the high-speed jaw assembly of the manipulator arm of FIG. 5.

Referring to FIGS. 19 and 20, the first jaw 74 of the high-speed jaw assembly 70 is shown. The jaw 74 has an arm 74A with bores 74A1 and 74A2. The bore 74A1 is the one that receives therein the pivot 73C. The bore 74A1 may be defined in a projection 74B (shown as a cylindrical projection, other shapes being possible). The projection 74B may increase the axial length of the bore 74A1 and hence add stability to the pivoting interconnection between the jaw 74 and the pivot 73C. The projection 74B may be on a single side of the arm 74A, for the arm 74A to define a flat plane 74C, such that the jaws 74 and 75 have their flat planes 74C and 75C against one another when assembled as in FIG. 4. Bore 74A2 (see 75A2 in FIG. 21) may be in a bracket-shaped support 74D (e.g., U bracket) for the linkage 72C to be received in a gap of the bracket-shaped support 74D. The guide pin 72E passes through the bore 74A2 to then project into the curved guide slot 73E (with FIG. 11 exemplifying this, for the alignment jaw assembly 50).

The jaw 74 may further have a casing 74E at the end of the arm 74A. The casing 74E receives the tube interface 76 of the jaw 74. The casing 74E may be box-shaped, with a pair of support plates 74F facing each other with a cavity between them. Shaft holes 74F1 may be defined in the support plates 74F. In an embodiment, the support plates 74F may be parallel to one another.

The tube interface 76 may be in the form of pulley-shaped roller 76A, defined by a circumferential groove, and mounted onto the shaft 76B. Alternatively, a cylindrical roller, a wheel, etc, could be used. The roller 76A is held in the cavity of the casing 74E so as to be rotatable about its shaft 76B. The roller 76A may have bearings 76D to ensure its smooth rotation. Also, spacers 76E may be present on the shaft 76B to provide clearance between the roller 76A and the casing 74E, and hence avoid rubbing contact or friction therebetween. The casing 74E is shaped and contoured such that a part of the roller 76A projects out of the casing 64E. Accordingly, a tube (i.e., inner tube or outer tube) received in between the jaws 74 and 75 will be in contact with the roller 76A, such as in the groove of the roller 76A, with an axis of rotation of the roller 76A being generally transverse to a translational movement of the tube. The tube interface 76 may not be powered in that it rotates on itself as the tube moves along it. While the tube interface 76 used with the jaw 74 is described as including roller 76A, other embodiments are considered, including balls. The roller 76A is convenient in that its groove is sized for different tube sizes to be compatible with the roller 76A, such as the inner tubes and outer tubes. In an embodiment, as shown in FIG. 20, the shape may be described as a sinusoidal or wave contour for a cross-sectional plane including a rotational axis of the roller 76A. Therefore, the inner tube would contact the valley portion of the wave contour, while the outer tube would contact simultaneously two "hills" as it would be too large to contact a bottom surface of the valley. Another way to describe the roller 76A is that it forms a trough shape, or that it forms a concave surface, a saddle outline, etc. The shaft 76B may have a connector 76C projecting eccentrically from its end. This is one of different arrangements considered to connect the shaft 76B to the casing 74E. This arrangement of FIGS. 19 and 20 is relatively small and hence well suited for the jaw 74 due to space constraints. As an alternative to the roller 76A, a sliding pad or surface could be used.

Figure 21:
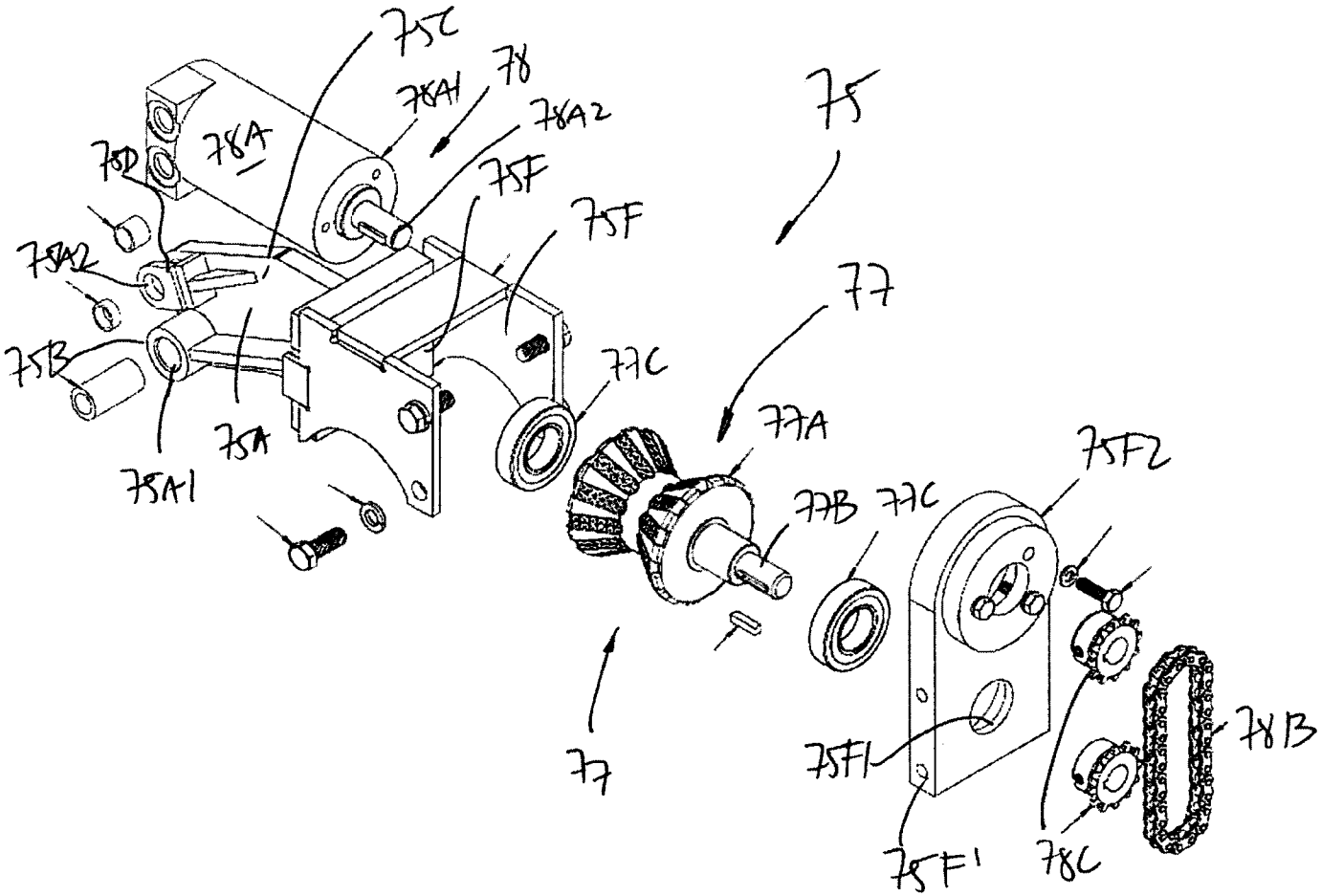
FIG. 21 is an exploded view of the second jaw of the high-speed jaw assembly of the manipulator arm of FIG. 5.
Figure 23:
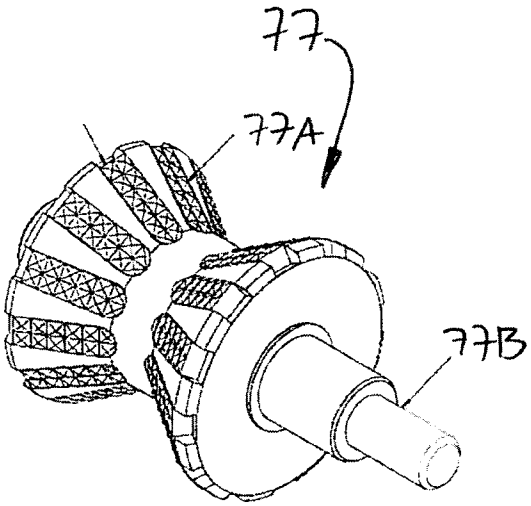
FIG. 23 is a perspective view of a drive roller of the second jaw of the high-speed jaw assembly of FIG. 22.
Figure 22:
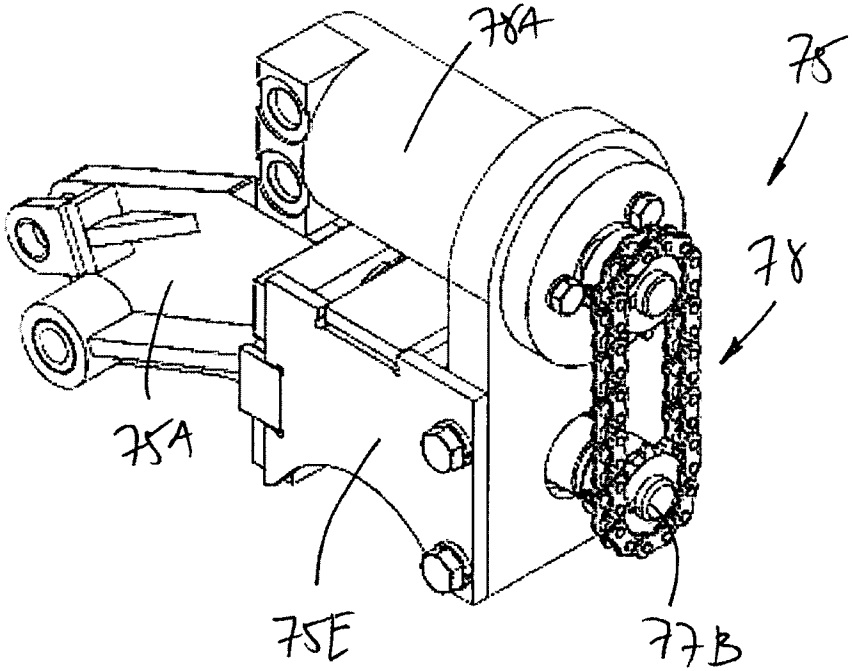
FIG. 22 is a perspective view of the second jaw of the high-speed jaw assembly of FIG. 21.

Referring to FIGS. 21, 22 and 23, the second jaw 75 of the high-speed jaw assembly 70 is shown. The second jaw 75 may have many parts in common with the first jaw 74, whereby a similar numbering of components is used, with the difference that components of the second jaw 75 are listed under 75, while components of the first jaw 74 are listed under 74. For example, the second jaw 75 has an arm 75A with bores 75A1 and 75A2, similar to the arm 74A with bores 74A1 and 74A2. The bore 75A1 is the one that receives therein the pivot 73C. The bore 75A1 may be defined in a projection 75B (shown as a cylindrical projection, as an example). The projection 75B may increase the axial length of the bore 75A1 and hence add stability to the pivoting interconnection between the jaw 75 and the pivot 73C. The projection 75B may be on a single side of the arm 75A, for the arm 75A to define a flat plane 75C, such that the jaws 74 and 75 have their flat planes 74C and 75C against one another when assembled as in FIG. 4. Bore 75A2 may be in a bracket-shaped support 75D (e.g., U bracket) for the linkage 72C to be received in a gap of the bracket-shaped support 75D. The guide pin 72E passes through the bore 75A2 to then project into the curved guide slot 73E, with FIG. 11 exemplifying this, for the alignment jaw assembly 50.

The second jaw 75 may further have a casing 75E at the end of the arm 76A. The casing 75E receives the tube interface 77 of the jaw 75. Here, the tube interface 77 used in the second jaw 75 is different from the tube interface 76 of the first jaw 74, notably because the tube interface 77 is driven, i.e., it is powered to induce a translation of a tube clamped in the high-speed jaw assembly 70.

The casing 75E may be box-shaped, with a pair of support plates 75F and 75F' facing each other with a cavity between them, in which components of the tube interface 77 may be received. The support plates 75F may differ from the support plates 74F of the first jaw 74, so as to support transmission features for receiving a drive. In an embodiment, the support plates 74F may be parallel to one another. The support plates 75F and 75F' may both have bearing receptacles 75F1 to hold bearings that will support the shaft of the tube interface 77, if present. The support plate 75F may have a greater size than the support plate 75F', so as to feature a motor mount 75F2.

The tube interface 77 may be in the form of a drive roller 77A mounted onto its shafts 77B. The shape may be viewed as to tapering portions facing each other, with a narrow portion between. Another wat to describe the shape is a pair of frusto-conical portions, for instance separated by a cylindrical portion, though the cylindrical portion could be optional. Other shapes, such as more arcuate ones, could be used. In an embodiment, the shape is sized for outer tubes to contact the tapering portions, while an inner tube is in contact with the narrow portion. In another embodiment, both inner tubes and outer tubes are on contact with the tapering portions. The controller 80 operates the high-speed jaw assembly 70 to avoid damage a surface of the inner tubes, by applying sufficient pressure to avoid slippage of the roller 77A relative to the tube therein. A spline connection, a key and slot (as shown), etc, may be present between the drive roller 77A and the shaft 77B to ensure concurrent rotation. Bearings 77C may be present to support the drive roller 77A, in one embodiment. The drive roller 77A may also be wheels, as an alternative. The drive roller 77A may have surface features to ensure slipless contact between the drive roller 77A and a tube against the surface of the roller 77A, as the drive roller 77A imparts a translation to the tube it contacts. Therefore, an axis of rotation of the drive roller 77A is generally transverse to a direction of translation. For example, the roller 77A may have a plurality of gripping members that come into contact with the outer tube, the gripping members being on the tapering portions, but not on the narrow portion, such that the inner tube contacting only the narrow portion may not be damaged. As the second jaw 75 is the drive jaw, it may be the only one in the high-speed jaw assembly 70 with surface texturing. The gripping members may be strips as shown, or the whole surfaces may be with a textured surface, for the roller 77A to grip onto a tube. In an embodiment, the gripping members or gripping surface is defined by carbide chips on the roller 77A. IN another embodiment, all of the surface of the roller 77A could be provided with surface texture, or with a coating or bushing of high friction material, such as a rubber for example. The roller 77A is held in the cavity of the casing 75E so as to be rotatable with its shaft 77B. The casing 75E is shaped and contoured such that a part of the drive roller 77A projects out of the casing 75E, for contacting the tube. Accordingly, a tube received in between the jaws 74 and 75 will be in contact with the rollers 76A and 77A. The drive roller 77A is also convenient in that different tube sizes may be used with the jaw 75 featuring the tube interface 77.

The shaft 77B may also project beyond the support plate 75F to be connected to a drive system 78. The drive system 78 may include a motor 78A. The motor 78A may have its housing 78A1 received in the motor mount 75F2, among other possibilities. In such an arrangement, the shaft 78A2 of the motor 78A projects beyond the support plate 75F. The motor 78A may be a bi-directional motor, i.e., it may rotate in both directions. In an embodiment, an electric motor is used, but other motor types may be used, include hydraulic and pneumatic. The drive system 78 may further include a transmission to couple the shaft 78A2 of the motor 78A to the drive roller 77A. According to an embodiment, the shaft 78A2 of the motor 78A is parallel to the shaft 77B, though other arrangements may be present as well. The motor 78A is atop the drive roller 77A in a compact arrangement of the components of the tube interface 77. The transmission may therefore include a chain 78B and sprockets 78C fixed to the shaft 78A2 of the motor 78A and to the shaft 77B of the drive roller 77A. As the sprockets 78C must rotate with the shafts 77B and 78A2 for transmission of rotation to the roller 77A, connection means, such as keys and slots (but alternatively threading engagement, splines) may be present. The sprockets 78C may be of different sizes for reduction to occur from the motor 78A to the roller 77A. As alternatives to the transmission of chain 78B and sprockets 78C, intermeshed gears, pulleys-cable sets and the like could be used. In yet another embodiment, the tube interface 77 could have a pair of drive rollers 77A. Two motors could be used, i.e., one for each direction of rotation. Chain guard 78E may be present, as shown in FIG. 24, to conceal the transmission, e.g., the chain 78B and sprockets 78C.

A shield plate 79 may be present, as shown in FIG. 1, to project the high-speed jaw assembly 70 from contacts during manipulations. The shield plate 79 may be made of a heavy duty material. As observed from FIG. 1, opposite ends of the manipulator arm 30 have shield plates 59 and 79, so as to protect the jaws. Another shield plate 59 faces the low-speed jaw assembly 60, and may protect the alignment jaw assembly 50 from an incoming tube.

The alignment jaw assembly 50, the low-speed jaw assembly 60 and the high-speed jaw assembly 70 may each be operated to clamp an inner tube and/or outer tube, as described above. In an embodiment, each of the assemblies 50, 60 and 70 closes with a respective single degree of actuation, for a single degree of freedom of movement of the jaw portions. In the illustrated embodiment, the single degree of actuation, as illustrated for example as a translation (a rotation being possible), results in both jaw portions moving toward one another, and thus have a centering effect. It is also considered to have a single one of the jaw portion being movable in one or more of the assemblies 50, 60 and 70.

In an embodiment, the rod handler apparatus 10 is for outer tubes and inner tubes, and may have at least the manipulator arm 30 adapted to be aligned with an elongated rod. An alignment jaw assembly 50 may be at a first end of the manipulator arm 30, the alignment jaw assembly 50 adapted to translationally support an inner tube and/or an outer tube in coaxial alignment with the elongated rod. A high-speed jaw assembly 70 may be at a second end of the manipulator arm 30, the high-speed jaw assembly 70 adapted to support at least the inner tube, the high-speed jaw assembly 70 operable to cause a translation of the inner tube in or out of the elongated rod. A low-speed jaw assembly 60 may be between the alignment jaw assembly 50 and the high-speed jaw assembly 70, the low-speed jaw assembly 60 adapted to support the outer tube, the low-speed jaw assembly 60 operable to cause concurrent translation and rotation of the outer tube for screwing engagement with the elongated rod.

Now that the various components of the rod handler apparatus 10 have been set out, an exemplary operation thereof is set forth. The automated operation of the rod handler apparatus 10 may be as a result of the operation of the controller 80. The manipulations may be different depending on whether an inner tube or an outer tube is manipulated.

As a starting point, the rod handler apparatus 10 is without a tube, and a tube is positioned between the jaw assemblies. In an embodiment, the positioning is done manually. The manipulator arm 30 may be in any given orientation to receive the tube therein, depending on user preference. For example, the tube may be generally upright when inserted into the jaw assemblies. This applies to both inner tubes and outer tubes.

Once the tube is in the jaw assemblies, at least a pair of the jaw assemblies are closed in the manner described above, for the tube to be retained by the jaw assemblies. In an embodiment, a user activates the closing of the jaw assemblies, for the controller 80 to actuate the various actuators. In an embodiment, it is the alignment jaw assembly 50 and the high-speed jaw assembly 70 that are closed to hold the tube, while the low-speed jaw assembly 60 remains opened. However, all three jaw assemblies may also be closed, or other pairs, such as the alignment jaw assembly 50 and the low-speed jaw assembly 60. In an embodiment, inner tubes are only manipulated by the alignment jaw assembly 50 and the high-speed jaw assembly 70. In an embodiment, outer tubes are manipulated by the alignment jaw assembly 50, and by the low-speed jaw assembly 60 and/or the high-speed jaw assembly 70.

With the tube retained by at least a pair of the jaw assemblies, the manipulator arm 30 may be displaced relative to the base 20 for the tube it retains to be in coaxial alignment with an elongated rod. The rod handler apparatus 10's position may have been adjusted beforehand for the coaxial alignment to be stored in the controller 80. A calibration procedure may also be performed, for example by an operator, for the coaxial alignment to be set. Multiple sensors may also be used to automate the coaxial alignment, with the controller 80 receiving sensor data to proceed. As explained above, there may be one or more DOFs between the manipulator arm 30 and the base 20, to achieve the coaxial alignment. For example, the embodiment of FIG. 1 may allow two rotational DOFs and one translational DOF, though fewer or more DOFs may be present.

In the case of an outer tube being manipulated, once in coaxial alignment with the elongated rod, the outer tube retained by the rod handler apparatus 10 may be brought in close proximity to the elongated rod, for threading engagement. In the case of the inner tube being manipulated by the apparatus 10, the manipulator arm 30 may feed the inner tube into the elongated rod. At this point, the tube may be retained by the alignment jaw assembly 50 at the distal end of the manipulator arm 30, and by the high-speed jaw assembly 70 at the proximal end of the manipulator arm 30 (FIG. 4). Alternatively, for the embodiment of FIG. 24, the tube may be retained by the alignment jaw assembly 50 at the proximal end of the manipulator arm 30, and by the high-speed jaw assembly 70 at the distal end of the manipulator arm 30. The low-speed jaw assembly 60 does not contact the tube at this moment. The drive roller 77A is operated by the controller 80 to force a translation of the tube toward the elongated rod, i.e., along direction parallel to X2. The drive roller 77A stops once the outer tube is in close proximity to the elongated rod. Alternatively the drive roller 77A stops once the inner tube is fed into the elongated rod. Again, sensors in the controller 80 may determine the close proximity. Such sensors may include limit switches, optical sensors, triggers, etc.

In the case of the outer tube being manipulated by the apparatus 10, with the outer tube in close proximity to the elongated rod, the low speed operation of screwingly engaging the outer tube to the elongated rod may be performed. The low-speed jaw assembly 60 is closed onto the outer tube, and the high-speed jaw assembly 70 releases the outer tube in the embodiment of FIG. 4. At that point, the outer tube is retained by the alignment jaw assembly 50 and the low-speed jaw assembly 60. In the embodiment of FIG. 24, the alignment jaw assembly 50 releases the outer tube for the outer tube to be supported by the jaw assemblies 60 and 70. The outer tube must translate toward the elongated rod, while rotating relative to the elongated rod, i.e. along its own longitudinal axis, to be screwingly engaged to it. The linear displacement assembly 40 and the low-speed jaw assembly 60 are operated simultaneously by the controller 80 to impart the concurrent translation and rotation to the outer tube. The drive rollers 67A cause the rotation, while the slider beam 41 translates relative to the beam 31 by action of the linear actuator 43 of the linear displacement assembly 40. The speed of rotation of the rollers 67A and translational velocity are controlled by the controller 80 for the smooth threading engagement of the outer tube with the elongated rod. If the outer tube is supported by both the jaw assemblies 60 and 70, the speed of the jaw assembly 70 is adjusted so as not to interfere with the threading engagement. In an embodiment, the jaw assembly 70 plays an idler role. Again, sensors such as force sensors may be used to control the translational velocity.

A reverse operation may be perform to detach an outer tube from the elongated rod.

From the perspective of the system featuring the rod handler apparatus 10 and controller 80, actions such as the following may occur: clamping onto an outer tube with a rod handler apparatus; screwing the outer tube onto an elongated rod with the rod handler apparatus; clamping onto an inner tube with the rod handler apparatus; translating the inner tube in or out of the elongated rod with the rod handler apparatus; translating the outer tube toward the elongated rod with the rod handler apparatus prior to screwing the outer tube; the translating the outer tube has a greater velocity than a translation during the screwing of the outer tube; the translating the inner tube has a greater velocity than a translation during the screwing of the outer tube; actuating a robotic arm to align a manipulator arm of the rod handler apparatus with the elongated rod prior to the screwing.

The above description is meant to be exemplary only, and one skilled in the art will recognize that changes may be made to the embodiments described without departing from the scope of the invention disclosed. For example, the use of the expressions "high speed" versus "low speed" should not be tied to any specific speeds, but instead should indicate that, relatively speaking, one speed is comparatively higher than the other. Still other modifications which fall within the scope of the present invention will be apparent to those skilled in the art, in light of a review of this disclosure, and such modifications are intended to fall within the appended claims.

The invention claimed is:

1. A rod handler apparatus for outer tubes and inner tubes, the rod handler apparatus comprising:

a manipulator arm adapted to be aligned with an elongated rod;

an alignment jaw assembly at a first end of the manipulator arm, the alignment jaw assembly adapted to translationally support an inner tube and/or an outer tube in coaxial alignment with the elongated rod;

a high-speed jaw assembly at a second end of the manipulator arm, the high-speed jaw assembly adapted to support at least the inner tube, the high-speed jaw assembly operable to cause a translation of the inner tube in or out of the elongated rod;

a low-speed jaw assembly between the alignment jaw assembly and the high-speed jaw assembly, the low-speed jaw assembly adapted to support the outer tube, the low-speed jaw assembly operable to cause concurrent translation and rotation of the outer tube for screwing engagement with the elongated rod; and a linear displacement assembly supporting the low-speed jaw assembly on the manipulator arm, the linear displacement assembly adapted to actuate a displacement of the low-speed jaw assembly in a translational degree of freedom relative to the manipulator arm, the linear displacement assembly and the low-speed jaw assembly operable simultaneously to cause concurrent translation and rotation of the outer tube for screwing engagement with the elongated rod.

2. The rod handler apparatus according to claim 1, wherein the alignment jaw assembly is actuatable in a single degree of freedom to clamp onto the inner tube and/or the outer tube.

3. The rod handler apparatus according to claim 2, wherein the alignment jaw assembly has a linear actuator to actuate a pair of jaw portions of the alignment jaw assembly to clamp onto the inner tube and/or the outer tube.

4. The rod handler apparatus according to claim 1, wherein the alignment jaw assembly has ball roller interfaces for interfacing with the inner tube and/or the outer tube.

5. The rod handler apparatus according to claim 1, wherein the alignment jaw assembly is fixed to the manipulator arm.

6. The rod handler apparatus according to claim 1, wherein the high-speed jaw assembly is actuatable in a single degree of freedom to clamp onto the inner tube and/or the outer tube.

7. The rod handler apparatus according to claim 6, wherein the high-speed jaw assembly has a linear actuator to actuate a pair of jaw portions of the high-speed jaw assembly to clamp onto the inner tube and/or the outer tube.

8. The rod handler apparatus according to claim 1, wherein the high-speed jaw assembly has a pair of rollers for interfacing with the inner tube and/or the outer tube, at least one of the rollers being driven and having a rotation axis transverse to a direction of translation of the inner tube and/or the outer tube.

9. The rod handler apparatus according to claim 8, further comprising a motor and a transmission coupling the motor to the driven one of the rollers.

10. The rod handler apparatus according to claim 8, wherein the driven one of the rollers has a textured contact surface.

11. The rod handler apparatus according to claim 1, wherein the high-speed jaw assembly is fixed to the manipulator arm.

12. The rod handler apparatus according to claim 1, wherein the low-speed jaw assembly is actuatable in a single degree of freedom to clamp onto the outer tube.

13. The rod handler apparatus according to claim 12, wherein the low-speed jaw assembly has a linear actuator to actuate a pair of jaw portions of the low-speed jaw assembly to clamp onto the outer tube.

14. The rod handler apparatus according to claim 1, wherein the low-speed jaw assembly has rollers for interfacing with the outer tube, at least one of the rollers being driven and having a rotation axis parallel to a direction of translation of the outer tube.

15. The rod handler apparatus according to claim 14, wherein the rollers are cylindrical rollers.

16. The rod handler apparatus according to claim 14, wherein the low-speed jaw assembly has two driven ones of the rollers, and two idler ones of the rollers, and wherein the low-speed jaw assembly is mounted to a frame of the linear displacement assembly to translate relative to the frame to impart the concurrent translation and rotation to the outer tube.

17. The rod handler apparatus according to claim 14, further comprising a motor and a transmission coupling the motor to the driven one of the rollers.

18. The rod handler apparatus according to claim 1, further including a base supporting the manipulator arm.

19. A system for manipulating outer tubes and inner tubes comprising:

one or more processing units; and a transitory computer-readable memory communicatively coupled to the processing unit and comprising computer-readable program instructions executable by the processing unit for clamping onto an outer tube with a rod handler apparatus;

simultaneously imparting concurrent translation and rotation of the outer tube to screwscrewing the outer tube onto an elongated rod with the rod handler apparatus;

clamping onto an inner tube with the rod handler apparatus; and translating the inner tube in or out of the elongated rod with the rod handler apparatus.

20. A rod handler apparatus for outer tubes and inner tubes, the rod handler apparatus comprising:

a manipulator arm adapted to be aligned with an elongated rod;

an alignment jaw assembly at a first end of the manipulator arm, the alignment jaw assembly adapted to translationally support an inner tube and/or an outer tube in coaxial alignment with the elongated rod;

a high-speed jaw assembly at a second end of the manipulator arm, the high-speed jaw assembly adapted to support at least the inner tube, the high-speed jaw assembly operable to cause a translation of the inner tube in or out of the elongated rod; and a low-speed jaw assembly between the alignment jaw assembly and the high-speed jaw assembly, the low-speed jaw assembly adapted to support the outer tube, the low-speed jaw assembly having rollers for interfacing with the outer tube, at least one of the rollers being driven and having a rotation axis parallel to a direction of translation of the outer tube, the low-speed jaw assembly operable to cause concurrent translation and rotation of the outer tube for screwing engagement with the elongated rod.

21. The rod handler apparatus according to claim 20, wherein the low-speed jaw assembly has two driven ones of the rollers, and two idler ones of the rollers, and wherein the low-speed jaw assembly is mounted to a frame of the manipulator arm to translate relative to the frame to impart the concurrent translation and rotation to the outer tube.

22. The rod handler apparatus according to claim 20, further comprising a motor and a transmission coupling the motor to the driven one of the rollers.

23. The rod handler apparatus according to claim 20, further including a base supporting the manipulator arm.

24. The rod handler apparatus according to claim 23, wherein the base provides degrees of freedom of movement to the manipulator arm.

25. The rod handler apparatus according to claim 24, wherein the base provides two rotational degrees of freedom of movement to the manipulator arm, the two rotational degrees of freedom being actuated.

* * * * *